US010493371B2

(12) United States Patent
Cochella et al.

(10) Patent No.: US 10,493,371 B2
(45) Date of Patent: Dec. 3, 2019

(54) TOY BUILDING SYSTEMS INCLUDING ADJUSTABLE CONNECTOR CLIPS, BUILDING PLANKS, AND PANELS

(71) Applicant: Building Creative Kids, LLC, Boulder, CO (US)

(72) Inventors: Christopher Cochella, Salt Lake City, UT (US); Christine Bieder Orris, Boulder, CO (US); Robert Charles Lubeck, Denver, CO (US)

(73) Assignee: Building Creative Kids, LLC, Boulder, CO (US)

( * ) Notice: Subject to any disclaimer, the term of this patent is extended or adjusted under 35 U.S.C. 154(b) by 177 days.

(21) Appl. No.: 15/539,549

(22) PCT Filed: Jul. 6, 2015

(86) PCT No.: PCT/US2015/039226
§ 371 (c)(1),
(2) Date: Jun. 23, 2017

(87) PCT Pub. No.: WO2016/111721
PCT Pub. Date: Jul. 14, 2016

(65) Prior Publication Data

US 2018/0021689 A1 Jan. 25, 2018

Related U.S. Application Data

(63) Continuation of application No. 29/513,902, filed on Jan. 6, 2015, now Pat. No. Des. 757,860.
(Continued)

(51) Int. Cl.
*A63H 33/00* (2006.01)
*A63H 33/10* (2006.01)

(52) U.S. Cl.
CPC ..... *A63H 33/101* (2013.01)

(58) Field of Classification Search
USPC ..... 446/85, 105, 111–115, 124, 126, 128; 211/45
See application file for complete search history.

(56) References Cited

U.S. PATENT DOCUMENTS 1,398,852 A 11/1921 Gilbert
1,492,560 A 5/1924 Fisher
(Continued)

FOREIGN PATENT DOCUMENTS

WO WO2016/111721 7/2016
WO WO 2016131039 8/2016

OTHER PUBLICATIONS

US 2014/0023288 A1, 01/2014, Mimlitch, III et al. (withdrawn)
(Continued)

*Primary Examiner* — Kurt Fernstrom
(74) *Attorney, Agent, or Firm* — Workman Nydegger

(57) ABSTRACT

Building sets including one or more blocks or planks and one or more connector clips configured to engage a thickness of the planks. Various types of planks, as well as various types of connecting clips may be provided, so as to provide open-ended building characteristics to users. Some connector clips may include a mating protrusion allowing the connector clip to be coupled to a hole or receptacle of another connector clip, or hub for connector clips, or into a hole of a plank. Such clips may be pivotable relative to the structure coupled to as a result of the mating protrusion connection. The building sets may provide proportional dimension characteristics between the planks and various connector clips, hubs, etc. One or more button connector clips may be provided with one or more panels, allowing panels to be integrated into the structural framework created with the connector clips and planks.

21 Claims, 24 Drawing Sheets

Related U.S. Application Data

(60) Provisional application No. 62/106,581, filed on Jan. 22, 2015, provisional application No. 62/115,458, filed on Feb. 12, 2015.

(56) References Cited

U.S. PATENT DOCUMENTS 2,278,327 A 3/1942 Magnus
2,414,716 A * 1/1947 Carson ..... A63H 33/105 446/112
3,599,360 A 8/1971 Lappo
3,747,262 A 7/1973 Endres
D230,759 S 3/1974 Hummel
3,827,177 A 8/1974 Wengel
3,955,510 A 5/1976 Kinik
3,998,002 A 12/1976 Nathanson
4,253,267 A 3/1981 Kocolowski
4,270,302 A 6/1981 Dandia
4,270,320 A 6/1981 Chamberlain
4,334,868 A 6/1982 Levinrad
4,444,321 A 4/1984 Carlstrom
4,557,064 A 12/1985 Thompson
4,616,571 A 10/1986 Lange
5,121,526 A * 6/1992 Burkard ..... A63H 33/10 24/336
5,137,486 A 8/1992 Glickman
5,172,534 A * 12/1992 Milner ..... A63H 33/042 446/104
5,175,913 A 1/1993 Mackie et al.
5,350,331 A 9/1994 Glickman
5,378,185 A 1/1995 Ban
5,482,491 A * 1/1996 Kichijyo ..... A63H 33/08 446/112
5,487,690 A 1/1996 Stoffle et al.
5,555,606 A 9/1996 Chu
5,605,486 A 2/1997 Zheng
5,729,867 A 3/1998 Carmichael
D393,417 S 4/1998 Glickman
5,746,638 A 5/1998 Shiraishi
5,827,104 A 10/1998 Zheng
5,901,859 A 5/1999 Carr et al.
D410,704 S 6/1999 Krog
5,984,756 A 11/1999 Krog
6,015,149 A 1/2000 Burk
6,059,631 A 5/2000 Maddock
6,068,533 A 5/2000 Glickman et al.
6,089,941 A 7/2000 Glickman et al.
6,186,698 B1 2/2001 Knapp
6,231,416 B1 5/2001 Clever
6,325,694 B1 12/2001 Clever
6,422,909 B2 7/2002 Clever et al.
6,500,007 B2 * 12/2002 Pupulin ..... A63H 33/04 273/157 R
D474,513 S * 5/2003 Kichijo ..... D21/503
6,592,421 B1 7/2003 Clever
6,645,032 B2 11/2003 Barringer et al.
6,648,715 B2 11/2003 Wiens et al.
6,672,931 B1 1/2004 Bagley
6,674,259 B1 1/2004 Norman et al.
6,676,474 B2 1/2004 Glickman
6,682,255 B2 1/2004 Battaglia
6,749,480 B1 6/2004 Hunts
6,843,700 B2 1/2005 Glickman
D513,471 S 1/2006 Sato
7,044,825 B2 5/2006 Glickman et al.
7,066,778 B2 6/2006 Kretzschmar
7,104,863 B2 9/2006 Mimlitch, III et al.
7,134,558 B1 11/2006 Mimlitch, III et al.
7,193,384 B1 3/2007 Norman et al.
7,201,279 B1 4/2007 Mimlitch, III et al.
7,222,684 B2 5/2007 Norman et al.
7,234,986 B2 6/2007 Kowalski et al.
7,237,404 B2 7/2007 Morano et al.
D547,977 S 8/2007 Bonatti
D550,484 S 9/2007 Bonatti
D550,549 S * 9/2007 Mounce ..... D8/395
7,267,598 B2 9/2007 Glickman
7,273,404 B2 9/2007 Kowalski et al.
7,275,646 B2 10/2007 Mimlitch, III et al.
7,330,776 B1 2/2008 Norman et al.
D563,213 S 3/2008 Sato
7,364,487 B2 4/2008 Evans et al.
7,371,146 B2 5/2008 Scarborough
7,413,493 B2 8/2008 Toht et al.
7,444,792 B2 11/2008 Matson
D588,651 S 3/2009 Sinisi
7,510,457 B2 3/2009 Hussa-Lietz
7,588,476 B2 9/2009 Hammond
7,591,056 B2 9/2009 Mimlitch, III et al.
7,666,054 B2 2/2010 Glickman
7,721,396 B2 5/2010 Fleischman
7,762,386 B2 7/2010 Allore
7,806,277 B2 10/2010 Mimlitch, III et al.
7,833,078 B2 11/2010 Kretzschmar
7,866,488 B2 1/2011 Mimlitch, III et al.
7,904,706 B2 3/2011 Lambert et al.
7,934,971 B2 5/2011 Mimlitch, III et al.
7,950,978 B2 5/2011 Norman et al.
7,955,155 B2 6/2011 Tremblay et al.
D641,805 S * 7/2011 Kichijo ..... D21/495
D644,696 S 9/2011 Mimlitch, III et al.
D644,697 S 9/2011 Mimlitch, III et al.
D644,698 S 9/2011 Mimlitch, III et al.
D644,699 S 9/2011 Mimlitch, III et al.
D645,525 S 9/2011 Norman et al.
D645,526 S 9/2011 Norman et al.
D645,527 S 9/2011 Norman et al.
D645,914 S 9/2011 Norman et al.
D645,915 S 9/2011 Norman et al.
D645,916 S 9/2011 Norman et al.
D645,917 S 9/2011 Norman et al.
D645,918 S 9/2011 Norman et al.
8,014,897 B2 9/2011 Norman et al.
8,038,503 B2 10/2011 Norman et al.
8,099,837 B2 1/2012 Santin
D654,121 S 2/2012 Mimlitch, III et al.
D657,826 S 4/2012 Mimlitch, III et al.
D657,827 S 4/2012 Mimlitch, III et al.
D663,787 S 7/2012 Mimlitch, III et al.
D663,788 S 7/2012 Mimlitch, III et al.
D664,216 S 7/2012 Mimlitch, III et al.
D664,218 S 7/2012 Mimlitch, III et al.
D667,509 S 9/2012 Mimlitch, III et al.
D667,511 S 9/2012 Norman et al.
D667,512 S 9/2012 Mimlitch, III et al.
D667,896 S 9/2012 Mimlitch, III et al.
D667,897 S 9/2012 Mimlitch, III et al.
D668,300 S 10/2012 Mimlitch, III et al.
D668,301 S 10/2012 Mimlitch, III et al.
D668,457 S 10/2012 Mimlitch, III et al.
D669,140 S 10/2012 Mimlitch, III et al.
D669,942 S 10/2012 Mimlitch, III et al.
D669,943 S 10/2012 Mimlitch, III et al.
D669,944 S 10/2012 Mimlitch, III et al.
8,292,687 B2 10/2012 Tremblay et al.
D670,769 S 11/2012 Mimlitch, III et al.
D670,770 S 11/2012 Mimlitch, III et al.
8,303,366 B2 11/2012 Tremblay et al.
D671,993 S 12/2012 Mimlitch, III et al.
8,337,270 B2 12/2012 Mimlitch, III et al.
D675,264 S 1/2013 Mimlitch, III et al.
D675,265 S 1/2013 Mimlitch, III et al.
D676,496 S 2/2013 Mimlitch, III et al.
D676,497 S 2/2013 Mimlitch, III et al.
D676,505 S 2/2013 Mimlitch, III et al.
D676,506 S 2/2013 Mimlitch, III et al.
D676,507 S 2/2013 Mimlitch, III et al.
D677,347 S 3/2013 Mimlitch, III et al.
D677,740 S 3/2013 Mimlitch, III et al.
D677,742 S 3/2013 Mimlitch, III et al.
D678,428 S 3/2013 Mimlitch, III et al.
D679,763 S 4/2013 Mimlitch, III et al.
D682,368 S 5/2013 Mimlitch, III et al.
D682,953 S 5/2013 Mimlitch, III et al.

(56) References Cited

U.S. PATENT DOCUMENTS

D683,411 S 5/2013 Mimlitch, III et al.
D684,218 S 6/2013 Mimlitch, III et al.
D684,221 S 6/2013 Mimlitch, III et al.
8,475,225 B2 7/2013 Kretzschmar
D687,903 S 8/2013 Mimlitch, III et al.
8,504,200 B2 8/2013 Norman et al.
8,505,086 B2 8/2013 Norman et al.
D689,141 S 9/2013 Mimlitch, III et al.
D689,142 S 9/2013 Mimlitch, III et al.
D689,143 S 9/2013 Mimlitch, III et al.
D689,144 S 9/2013 Mimlitch, III et al.
D689,145 S 9/2013 Mimlitch, III et al.
D689,146 S 9/2013 Mimlitch, III et al.
D689,147 S 9/2013 Mimlitch, III et al.
D689,148 S 9/2013 Mimlitch, III et al.
D689,149 S 9/2013 Mimlitch, III et al.
D689,150 S 9/2013 Mimlitch, III et al.
D689,151 S 9/2013 Mimlitch, III et al.
D689,152 S 9/2013 Mimlitch, III et al.
D689,561 S 9/2013 Mimlitch, III et al.
D689,562 S 9/2013 Mimlitch, III et al.
D689,563 S 9/2013 Mimlitch, III et al.
D689,564 S 9/2013 Mimlitch, III et al.
D689,565 S 9/2013 Mimlitch, III et al.
D689,959 S 9/2013 Mimlitch, III et al.
D689,960 S 9/2013 Mimlitch, III et al.
D689,961 S 9/2013 Mimlitch, III et al.
D689,962 S 9/2013 Mimlitch, III et al.
D689,964 S 9/2013 Mimlitch, III et al.
8,529,311 B2 9/2013 Tremblay et al.
D692,070 S 10/2013 Mimlitch, III et al.
8,550,235 B2 10/2013 Suderman
D692,965 S 11/2013 Mimlitch, III et al.
D693,889 S 11/2013 Mimlitch, III et al.
D694,344 S 11/2013 Mimlitch, III et al.
D694,345 S 11/2013 Mimlitch, III et al.
8,591,281 B2 11/2013 Mimlitch, III et al.
D694,840 S 12/2013 Mimlitch, III et al.
D695,362 S 12/2013 Mimlitch, III et al.
D696,732 S 12/2013 Mimlitch, III et al.
D696,733 S 12/2013 Mimlitch, III et al.
8,612,051 B2 12/2013 Norman et al.
8,616,463 B2 12/2013 Mimlitch, III et al.
D697,147 S 1/2014 Mimlitch, III et al.
D698,395 S 1/2014 Norman et al.
D699,302 S 2/2014 Mimlitch, III et al.
D700,251 S 2/2014 Mimlitch, III et al.
8,651,914 B2 2/2014 Sisamos
D700,661 S 3/2014 Mimlitch, III et al.
D702,776 S 4/2014 Norman et al.
D703,767 S 4/2014 Mimlitch, III et al.
8,696,399 B2 4/2014 Mimlitch, III et al.
D705,874 S 5/2014 Norman et al.
8,721,384 B2 5/2014 Norman et al.
D706,362 S 6/2014 Norman et al.
D706,363 S 6/2014 Norman et al.
D706,877 S 6/2014 Norman et al.
D707,276 S 6/2014 Norman et al.
D707,304 S 6/2014 Norman et al.
D707,305 S 6/2014 Norman et al.
D707,306 S 6/2014 Norman et al.
D707,757 S 6/2014 Mimlitch, III et al.
D707,758 S 6/2014 Norman et al.
D708,680 S 7/2014 Norman et al.
D711,972 S 8/2014 Norman et al.
D711,973 S 8/2014 Norman et al.
D711,974 S 8/2014 Norman et al.
D711,975 S 8/2014 Norman et al.
D711,976 S 8/2014 Norman et al.
D711,977 S 8/2014 Norman et al.
D711,978 S 8/2014 Norman et al.
D711,979 S 8/2014 Norman et al.
D711,980 S 8/2014 Norman et al.
D711,981 S 8/2014 Norman et al.
8,810,387 B2 8/2014 Norman et al.
D712,489 S 9/2014 Norman et al.
8,834,226 B2 9/2014 Norman et al.
8,834,227 B2 9/2014 Norman et al.
D715,871 S 10/2014 Norman et al.
D715,873 S 10/2014 Norman et al.
D715,874 S 10/2014 Norman et al.
D716,384 S 10/2014 Norman et al.
8,858,294 B2 10/2014 Mimlitch, III et al.
D716,879 S 11/2014 Norman et al.
D717,380 S 11/2014 Mimlitch, III et al.
D717,886 S 11/2014 Mimlitch, III et al.
8,882,558 B2 11/2014 Norman et al.
D720,419 S 12/2014 Norman et al.
8,905,813 B2 12/2014 Norman et al.
8,913,393 B2 12/2014 Mimlitch, III et al.
8,913,398 B2 12/2014 Mimlitch, III et al.
D720,823 S 1/2015 Norman et al.
D720,824 S 1/2015 Norman et al.
D720,825 S 1/2015 Norman et al.
D740,368 S 1/2015 Norman et al.
D722,665 S 2/2015 Norman et al.
D723,123 S 2/2015 Norman et al.
D724,028 S 3/2015 Norman et al.
D725,037 S 3/2015 Norman et al.
D725,733 S 3/2015 Norman et al.
8,968,046 B2 3/2015 Cochella
9,004,974 B2 * 4/2015 Brooks ..... A63H 33/10 446/114
9,017,136 B2 4/2015 Norman et al.
D731,449 S 6/2015 Norman et al.
9,050,540 B1 6/2015 Norman et al.
9,050,541 B2 6/2015 Mimlitch, III et al.
D733,530 S 7/2015 Tonthat et al.
D733,531 S 7/2015 Tonthat et al.
9,149,731 B2 10/2015 Mimlitch, III et al.
9,162,153 B1 10/2015 Mimlitch, III et al.
9,162,154 B2 10/2015 Mimlitch, III et al.
D747,688 S 1/2016 Norman et al.
D747,776 S 1/2016 Norman et al.
9,233,313 B2 1/2016 Olivera et al.
9,238,178 B2 1/2016 Mimlitch, III et al.
D750,177 S 2/2016 Norman et al.
D752,518 S 3/2016 Norman et al.
9,289,694 B2 3/2016 Norman et al.
D757,860 S 5/2016 Cochella
D758,225 S 6/2016 Norman et al.
D759,466 S 6/2016 Tonthat et al.
9,360,052 B2 6/2016 Culver et al.
9,370,119 B2 6/2016 Tonthat et al.
9,370,724 B2 6/2016 Norman et al.
D760,579 S 7/2016 Tonthat et al.
9,399,177 B2 7/2016 Cochella
2002/0104942 A1 8/2002 Mimlitch, III et al.
2002/0121395 A1 9/2002 Norman et al.
2003/0175669 A1 9/2003 Mimlitch, III et al.
2003/0176142 A1 9/2003 Mimlitch, III et al.
2004/0077257 A1 4/2004 Mimlitch, III et al.
2006/0129846 A1 6/2006 Lambert et al.
2007/0131628 A1 6/2007 Mimlitch, III et al.
2007/0135017 A1 6/2007 Norman et al.
2007/0227992 A1 10/2007 Mimlitch, III et al.
2008/0100250 A1 5/2008 Norman et al.
2008/0175659 A1 7/2008 Mimlitch, III et al.
2008/0220689 A1 9/2008 Mimlitch, III et al.
2008/0263628 A1 10/2008 Norman et al.
2008/0269949 A1 10/2008 Norman et al.
2009/0218301 A1 9/2009 Mimlitch, III et al.
2010/0242250 A1 9/2010 Haughey et al.
2011/0028069 A1 2/2011 Norman et al.
2011/0076914 A1 3/2011 Norman et al.
2011/0076916 A1 3/2011 Norman et al.
2011/0076917 A1 3/2011 Norman et al.
2011/0076918 A1 3/2011 Norman et al.
2011/0111671 A1 5/2011 Norman et al.
2011/0117814 A1 5/2011 Norman et al.
2011/0151742 A1 6/2011 Norman et al.
2012/0015585 A1 1/2012 Norman et al.
2012/0029695 A1 2/2012 Norman et al.
2012/0034839 A1 2/2012 Murphy

(56) References Cited

U.S. PATENT DOCUMENTS

| | | | |
|---|---|---|---|
| 2012/0080533 | A1 | 4/2012 | Mimlitch, III et al. |
| 2012/0178339 | A1 | 7/2012 | Mimlitch, III et al. |
| 2012/0178340 | A1 | 7/2012 | Mimlitch, III et al. |
| 2012/0264341 | A1 | 10/2012 | Mimlitch, III et al. |
| 2012/0302127 | A1 | 11/2012 | Doskas |
| 2013/0084771 | A1 | 4/2013 | Mimlitch, III et al. |
| 2013/0084773 | A1 | 4/2013 | Mimlitch, III et al. |
| 2013/0084774 | A1 | 4/2013 | Mimlitch, III et al. |
| 2013/0084775 | A1 | 4/2013 | Mimlitch, III et al. |
| 2013/0090037 | A1 | 4/2013 | Mimlitch, III et al. |
| 2013/0091689 | A1 | 4/2013 | Mimlitch, III et al. |
| 2013/0095722 | A1 | 4/2013 | Cochella |
| 2013/0149935 | A1 | 6/2013 | Mimlitch, III et al. |
| 2013/0171910 | A1 | 7/2013 | Mimlitch, III et al. |
| 2013/0267145 | A1 | 10/2013 | Rosen et al. |
| 2014/0045403 | A1 | 2/2014 | Murphy |
| 2014/0057525 | A1 | 2/2014 | Olivera et al. |
| 2014/0094088 | A1 | 4/2014 | Olivera et al. |
| 2015/0084494 | A1 | 3/2015 | Tonthat et al. |
| 2015/0165331 | A1 | 6/2015 | Norman et al. |
| 2015/0219164 | A1 | 8/2015 | Culver et al. |
| 2015/0224413 | A1 | 8/2015 | Mimlitch, III et al. |
| 2015/0224415 | A1 | 8/2015 | Brooks |
| 2015/0306510 | A1 | 10/2015 | Mimlitch, III et al. |
| 2015/0306511 | A1 | 10/2015 | Norman et al. |
| 2015/0306514 | A1 | 10/2015 | Mimlitch, III et al. |
| 2016/0009348 | A1 | 1/2016 | Mimlitch, III et al. |
| 2017/0007938 | A1 | 1/2017 | Brooks |
| 2017/0113158 | A1 | 4/2017 | Cochella |
| 2017/0120158 | A1 | 5/2017 | Cochella |
| 2017/0120159 | A1 | 5/2017 | Cochella |

OTHER PUBLICATIONS

U.S. Appl. No. 15/216,887, filed Sep. 5, 2017, Office Action.
U.S. Appl. No. 15/216,887, filed Jul. 22, 2016, Cochella.
Photographs of prototype product seen at MindWare booth at Toy Fair 2015 (in New York City), based on information and belief, photographed Feb. 17, 2015 (2 photographs).
Product Brochure for Keva Maker Bot Maze, based on information and belief, provided to applicant on or about Jul. 20, 2015.
Wikipedia "Lego" Available at least as early as May 13, 2016, 10 pages "https://en.wikipedia.org/w/index.php?title=Lego&oldid=720051184".
Wikipedia "Mortise and Tenon" Available at least as early as Apr. 4, 2016, 5 pages "https://en.wikipedia.org/w/index.php?title=Mortise_and_tenon&oldid=713513834".
"Tinkertoy" Wikipedia, the free encyclopedia, accessed Aug. 15, 2016 at https://en.wikipedia.org/wiki/Tinkertoy 3 pages.
International Search Report and Written Opinion for PCT/US2015/039226 dated Sep. 29, 2015 12 pages.
"Locktagons" in Patch Products 2010 Catalog, 2 pages.
"Dollhouse Designer" by Lakeshore, Accessed Nov. 1, 2016, 4 pages, Available atvvww.lakeshorelearning.com/product/productDet.jsp?productItemID=1 %2C689%2C949%2C371 %2C931 %2C428 &ASSORTMENT%3C% 3East id=1408474395181113&bmUID=1495141244451.
Photos of "Locktagons" product packaging and Product Insert, by Patch Products, LLC, Purchased and photographed in spring 2017, Copyright date of 2015, 5 pages.
U.S. Appl. No. 13/612,383, filed May 5, 2014, Restriction Requirement.
U.S. Appl. No. 13/612,383, filed Aug. 7, 2014, Office Action.
U.S. Appl. No. 13/612,383, filed Dec. 31, 2014, Notice of Allowance.
U.S. Appl. No. 29/513,902, filed Jan. 22, 2016, Notice of Allowance.
U.S. Appl. No. 14/962,937, filed Mar. 15, 2016, Office Action.
U.S. Appl. No. 14/962,937, filed May 23, 2016, Notice of Allowance.
U.S. Appl. No. 15/402,619, filed Oct. 29, 2018, Office Action.
U.S. Appl. No. 15/402,604, filed Oct. 30, 2018, Office Action.
U.S. Appl. No. 15/402,636, filed Oct. 31, 2018, Office Action.
U.S. Appl. No. 29/566,185, filed Nov. 16, 2018, Office Action.
"Wonderhood—build a world of possibilities", https.wonderhoodtoys.com, available at least as early as Mar. 4, 2017, pp. 1-14.
"CitiBlocs Product Brochure", available at least as early as Apr. 20, 2016, pp. 1.
"Roominate", https://www.playmonster.com/brands/roominate/, available at least as early as Mar. 16, 2016, pp. 1-5.

* cited by examiner

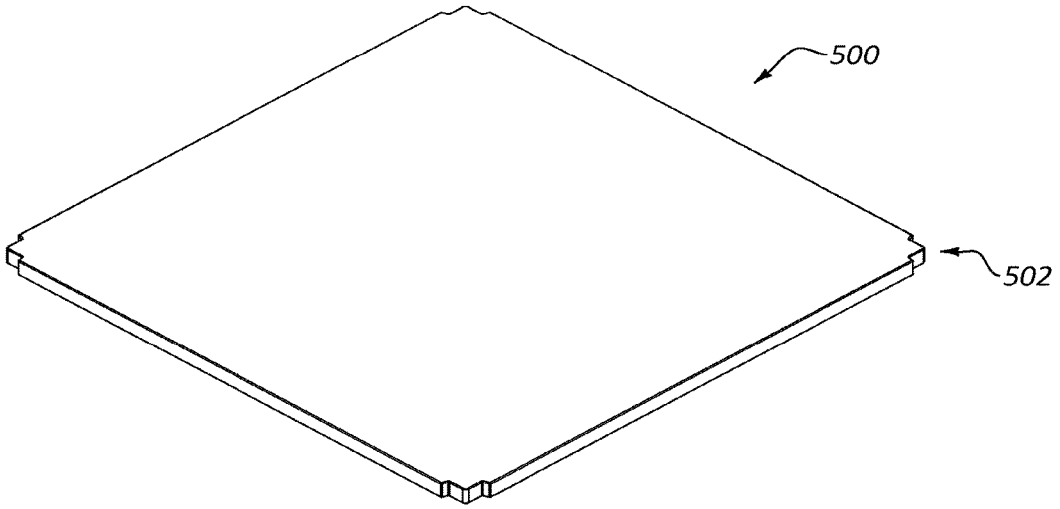
FIG. 11
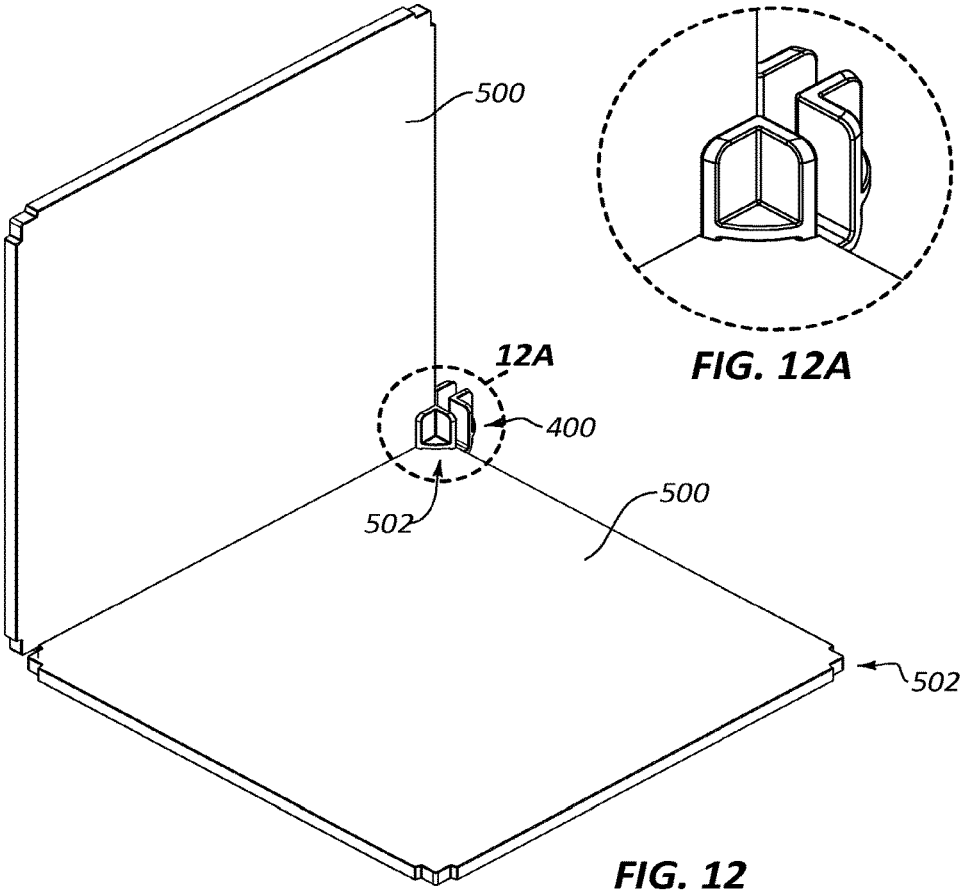
FIG. 12A
FIG. 12

TOY BUILDING SYSTEMS INCLUDING ADJUSTABLE CONNECTOR CLIPS, BUILDING PLANKS, AND PANELS

CROSS-REFERENCE TO RELATED APPLICATIONS

The present application claims priority to U.S. Design patent application Ser. No. 29/513,902 filed Jan. 6, 2015, entitled TOY COUPLER; U.S. Provisional Patent Application Ser. No. 62/106,581 filed Jan. 22, 2015, entitled TOY COUPLER; and U.S. Design Patent Application Ser. No. 62/115,458 filed Feb. 12, 2015, entitled TOY BUILDING SYSTEMS INCLUDING ADJUSTABLE CONNECTOR CLIPS, BUILDING PLANKS, AND PANELS. The present application also incorporates by reference the entire disclosure of each of U.S. Provisional Patent Application Ser. No. 61/546,912 filed Oct. 13, 2011, entitled BUILDING SETS INCLUDING BLOCKS AND MAGNETIC COUPLING CLIPS; U.S. Provisional Patent Application Ser. No. 61/594,850 filed Feb. 3, 2012, entitled TOY COUPLERS INCLUDING A PLURALITY OF BLOCK RETAINING CHANNELS; U.S. patent application Ser. No. 13/612,383 filed Sep. 12, 2012, entitled TOY COUPLERS INCLUDING A PLURALITY OF BLOCK RETAINING CHANNELS, now U.S. Pat. No. 8,968,046.

BACKGROUND OF THE INVENTION

The Field of the Invention

The present invention relates to building sets, particularly toy building sets including a plurality of blocks or building planks to be indirectly coupled together through use of various couplers.

The Relevant Technology

Various building sets have been used by children and others for decades for amusement and learning. Sets of blocks include a plurality of variously configured blocks that allow a user to stack the blocks on top of one another in order to form various structures or buildings. Stacking configurations that can be achieved are often limited as a result of gravity.

Such building systems are severely limited in their ability to build relatively realistic building structures such as those employing post and beam construction in which elongate blocks can be secured to one another in an erector like configuration, but in which connections can be more easily achieved (e.g., by a child as young as 3, such as between 3 and 8 years old, or from about 4 to about 8). For example, while some existing building sets allow for erector like connection configurations and mechanisms, the connectors and blocks, and posts or beams of such systems do not readily provide for open-ended, more creative connectivity, but are rather binary in their mechanism of connection.

BRIEF SUMMARY

According to an aspect, the present invention is directed to a building set comprising one or more planks (e.g., rectangular), at least one of which includes a first face, an opposing second face, a first side, an opposed second side, a first end, and an opposed second end, the at least one plank including a thickness defined between opposed faces, opposed sides, or opposed ends. The building set may also include one or more connector clips, at least one of the connector clips including a clip body and a plank engaging channel extending from the clip body. The channel of the clip may include a base disposed on the central body, the base defining a floor. The channel may include first and second substantially parallel extensions, each including interior surfaces, the extensions extending distally from the base and defining a channel there between into which the thickness defined between opposed faces of the plank is receivable, a width of the channel being substantially equal to the thickness of the plank that is receivable within the channel so that the extensions pinch the thickness of the plank received within the channel, frictionally coupling the connector clip to a plank received within the channel. The connector clip may further include a mating protrusion also extending from the clip body, the mating protrusion being sized and shaped for receipt into a corresponding hole or recess of another connector clip, a hub that removably receives and retains one or more connector clips, and/or a hole or recess through one of the planks.

Another building set may include one or more planks, and one or more first connector clips. At least one of the connector clips may include a clip body and a plank engaging channel extending from the clip body. The channel of the clip may include base disposed on the central body, the base defining a floor, and first and second substantially parallel extensions, each including interior surfaces. The extensions may extend distally from the base and define a channel therebetween into which the thickness defined between opposed faces of the plank is receivable, so that the thickness of the plank received within the channel is pinched therein. In an embodiment, one or more of the planks (e.g., rectangular) may include a hole formed through the thickness between the faces.

Any of the contemplated building sets may be proportional. For example, in an embodiment, at least one plank has a length that is a whole number of units in length, and the connector clip includes two channels disposed on opposite sides of the connector clip, a distance from the floor of one channel to the floor of the opposite channel being equal to one unit in length. In another example, the building set is proportional so that at least one of the connector clips comprises a mating protrusion also extending from the clip body opposite from the channel of the connector clip, the mating protrusion being sized and shaped for receipt into the hole of the at least one plank and/or a similarly sized hole of another connector clip, wherein the at least one plank has a length that is a whole number of units in length, and the connector clip including the mating protrusion includes a distance from the floor of the channel to the distal end of the mating protrusion being equal to one-half unit in length. For example, a unit may be approximately 2 and ⅜ inches in length.

Any of the building sets may further include a button connector clip comprising a mating protrusion extending from a button connector clip body, the mating protrusion being sized and shaped for receipt into a hole of a plank and/or another connector clip, the button connector clip further comprising one or more channels formed into the button connector clip body opposite from the mating protrusion of the button connector clip. The one or more channels of the button connector clip body may be narrower than the channel of the first connector clip, so as to be capable of receiving and retaining a thickness of a panel that is thinner than the planks, rather than the one or more rectangular planks. Such a building set may further include one or more panels for retention within the channels of the button connector clip.

The building sets may further include crayons, markers, other writing instruments, stickers, decals, etc. that may be used to write on or otherwise decorate such panels. In an embodiment, the panels may be easily erasable (e.g., dry erase or similar thereto), allowing the user to build a structure with the building set, and write on, color, or otherwise decorate the panels. Such writing, coloring, or decorating may be erased when the building is disassembled, and the panels may be redecorated (e.g., differently) when another building is created. While erasable crayons, markers, pencils, or other instruments may be preferred, permanent, non-erasable decorating is also possible.

BRIEF DESCRIPTION OF THE DRAWINGS

To further clarify the above a more particular description of the disclosure will be rendered by reference to specific examples that are illustrated in the appended drawings. It is appreciated that these drawings depict only typical examples and are therefore not to be considered limiting. The examples will be described and explained with additional specificity and detail through the use of the accompanying drawings in which:

FIG. 11 illustrates an exemplary panel that may be secured to a structure formed from blocks or planks and the connector clips;

FIG. 12 illustrates how the button clip and panels may be secured to one another;

FIG. 20 is a photograph showing an example of how exemplary building sets may be used in construction of a structure.

Together with the following description, the figures demonstrate non-limiting features of exemplary devices and methods. The same reference numerals in different drawings represent similar, though not necessarily identical, elements.

DETAILED DESCRIPTION OF THE PREFERRED EMBODIMENTS

I. Basic Building Systems

The present invention is directed to building sets including a plurality of blocks or planks (used interchangeably herein) and a plurality of connector clips configured to frictionally engage one or more of the blocks or planks. The connector clips facilitate coupling of various blocks (e.g., elongate "post" and "beam" type blocks) together (with a connector clip in between) in various configurations not possible when stacking blocks alone (e.g., arches, bridges, trusses, eaves, girders, posts, beams, and other structures and buildings). Because the connection between the block and clip is friction based, and is not binary (i.e., only connecting in one manner) in its mechanism, a high degree of freedom is available in placement of the connector clips.

Figure 1A:
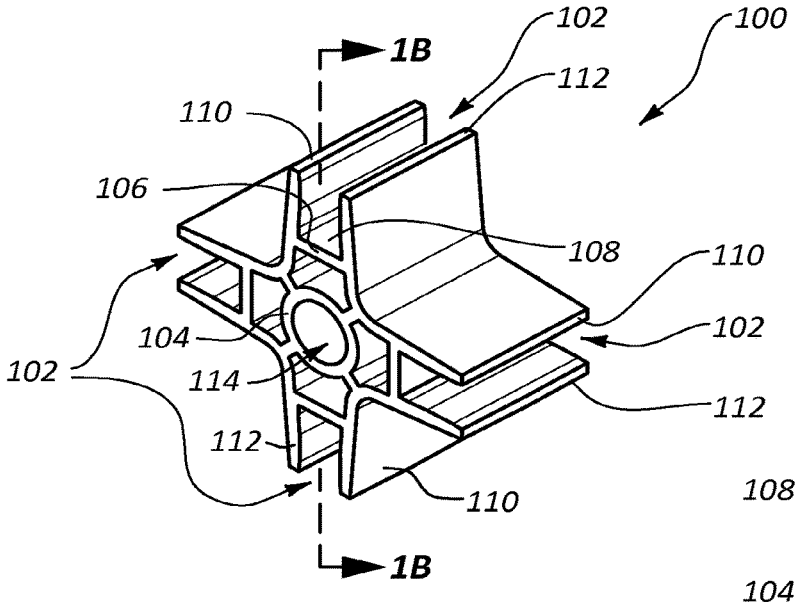
FIG. 1A is an isometric view of an exemplary clip configuration including multiple channels.
Figure 1B:
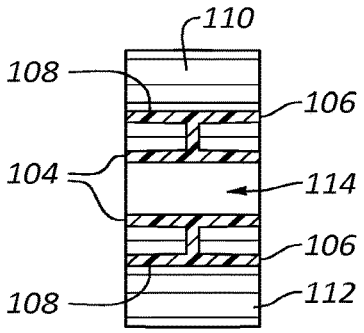
FIG. 1B is a cross-sectional view through the clip of FIG. 1A.
Figure 1C:
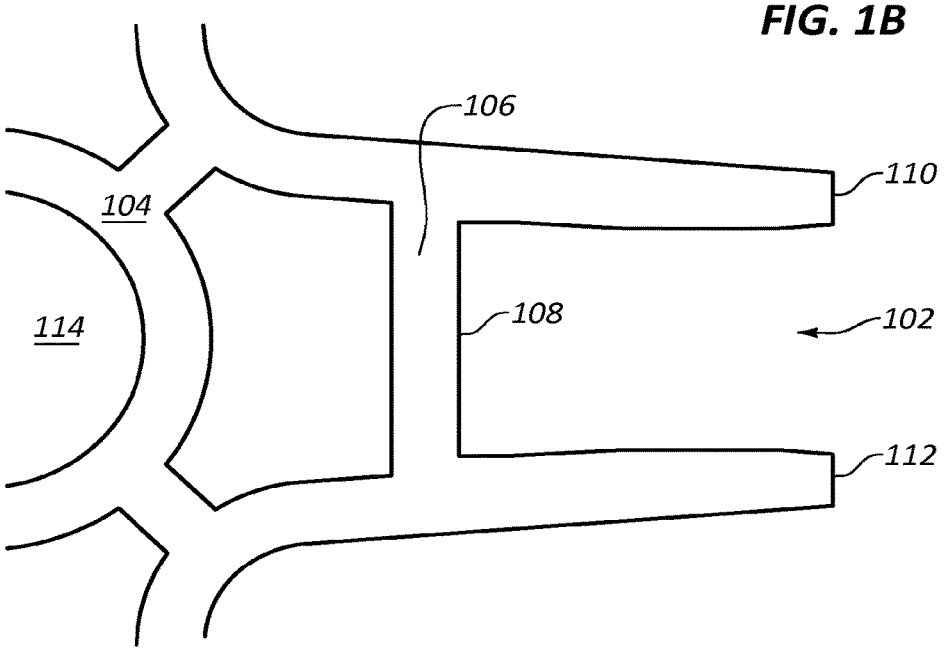
FIG. 1C is a close up plan view of a channel of the clip of FIG. 1A.
Figure 1D:
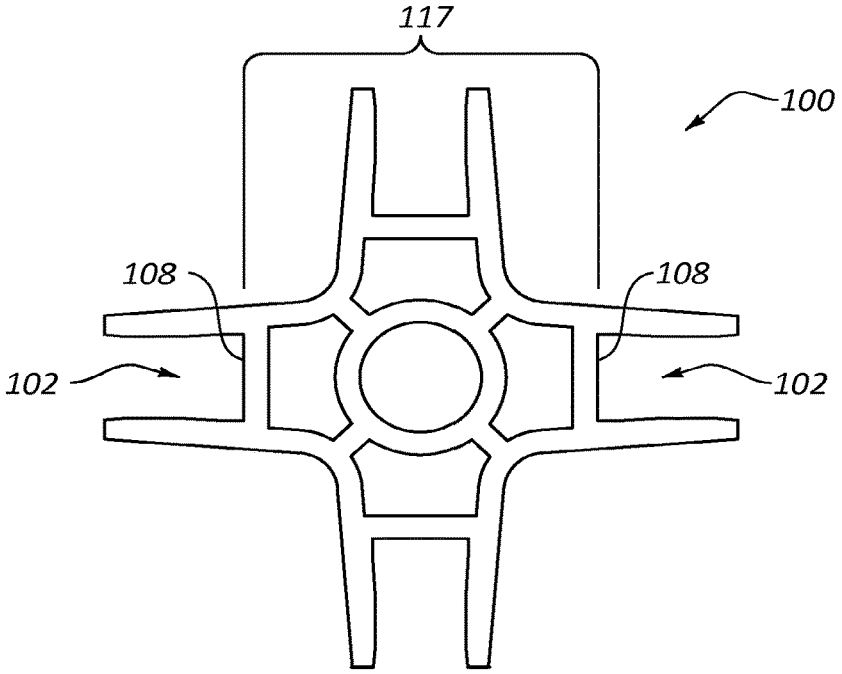
FIG. 1D shows a plan view of the clip of FIG. 1A.

FIGS. 1A-ID show various views of an exemplary clip configuration 100 that includes at least one channel 102. Clip 102 may include multiple channels 102 that allows clip 100 to engage one or more blocks simultaneously.

Figure 3A:
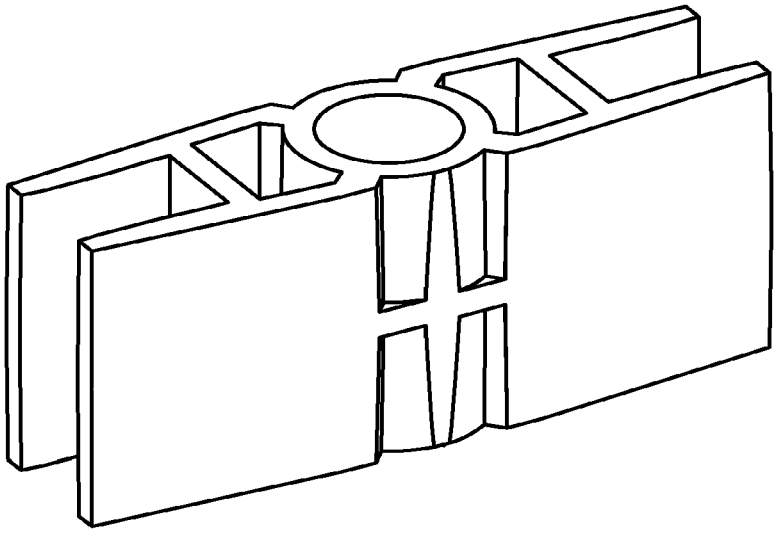
FIGS. 3A-3B illustrate alternative clip connectors including two and three channels, respectively.
Figure 3B:
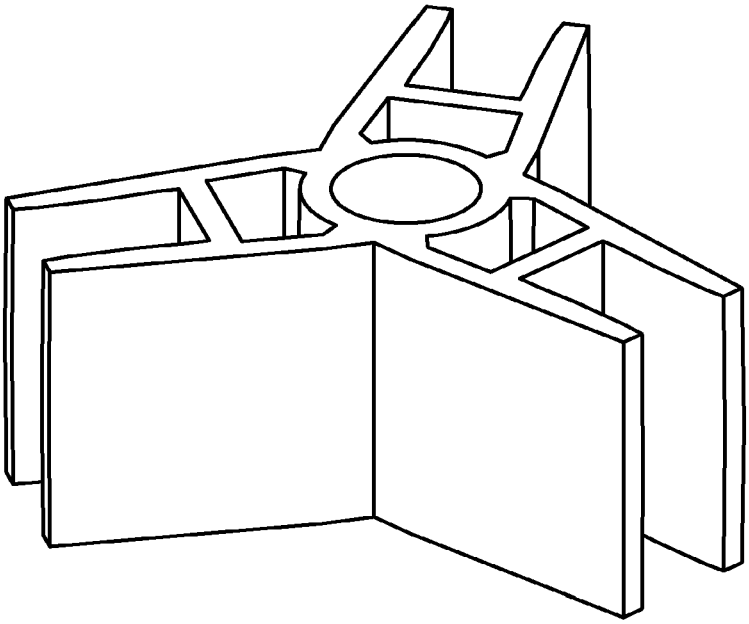

Connector clip 100 includes a central body 104 and a plurality of channels 102 disposed so as to extend from central body 104. Although four channels are illustrated, it will be understood that more or fewer channels may be provided (e.g., 2, 3, 5, 6, etc.). FIGS. 3A and 3B show clips including 2 and 3 channels, respectively. While each channel 102 is illustrated as being configured with equal width, and spaced apart from one another at equal angles, it will be understood that one or more of the channels may have a different width or spacing than another of the channels. In addition, while all channels are shown to be oriented in a particular orientation, it will be understood that one or more of the channels may be differently oriented (e.g., transverse to another channel, otherwise angled relative thereto, etc.).

For simplicity connector clip 100 may also simply be referred to as clip 100. Each channel 102 of clip 100 is shown as including a base 106 disposed on central body 104. Each base 106 defines an interior floor surface 108 of each channel 102. The sides of each channel 102 are bounded by extensions 110 and 112, which may be substantially parallel to each other. As described above, a thickness defined between opposed faces, sides, or ends of one or more blocks is receivable within any of channels 102. The width of channel 102 is substantially equal to the thickness of the corresponding block that is retainably engaged within a given channel.

Figure 16:
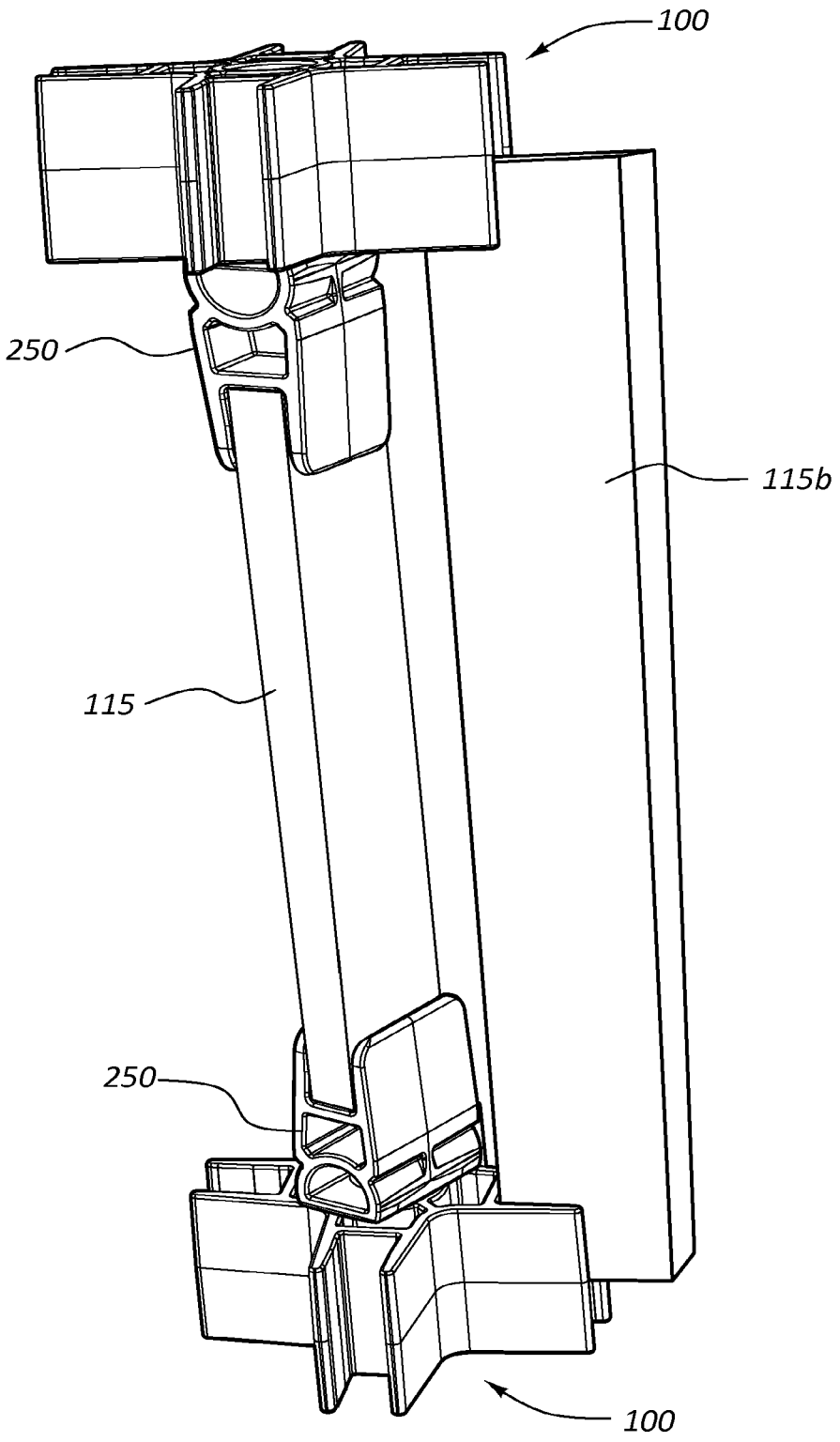
FIGS. 16-17 illustrate proportional building characteristics of an embodiment of the present building sets.
Figure 17:
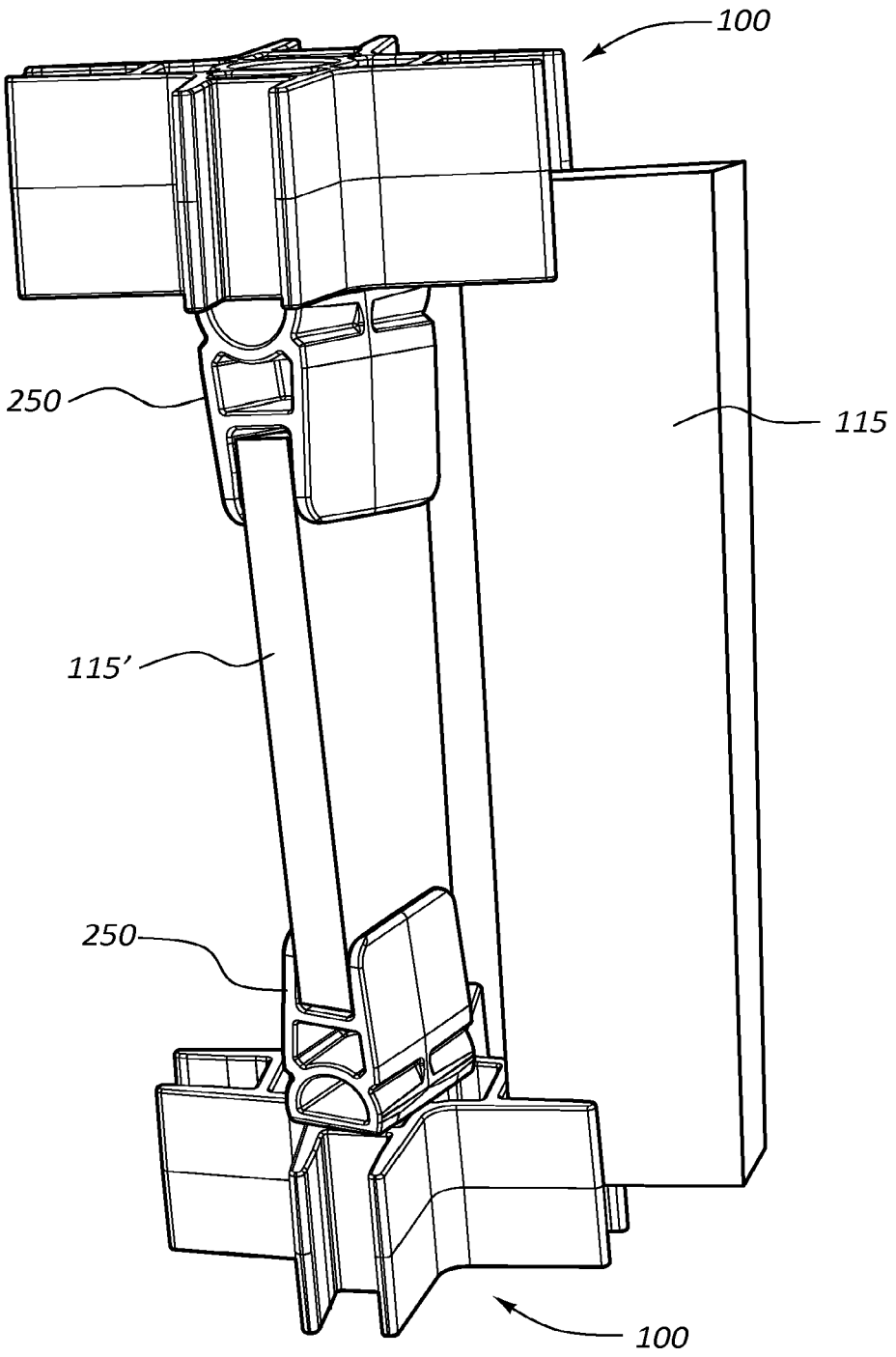
Figure 18:
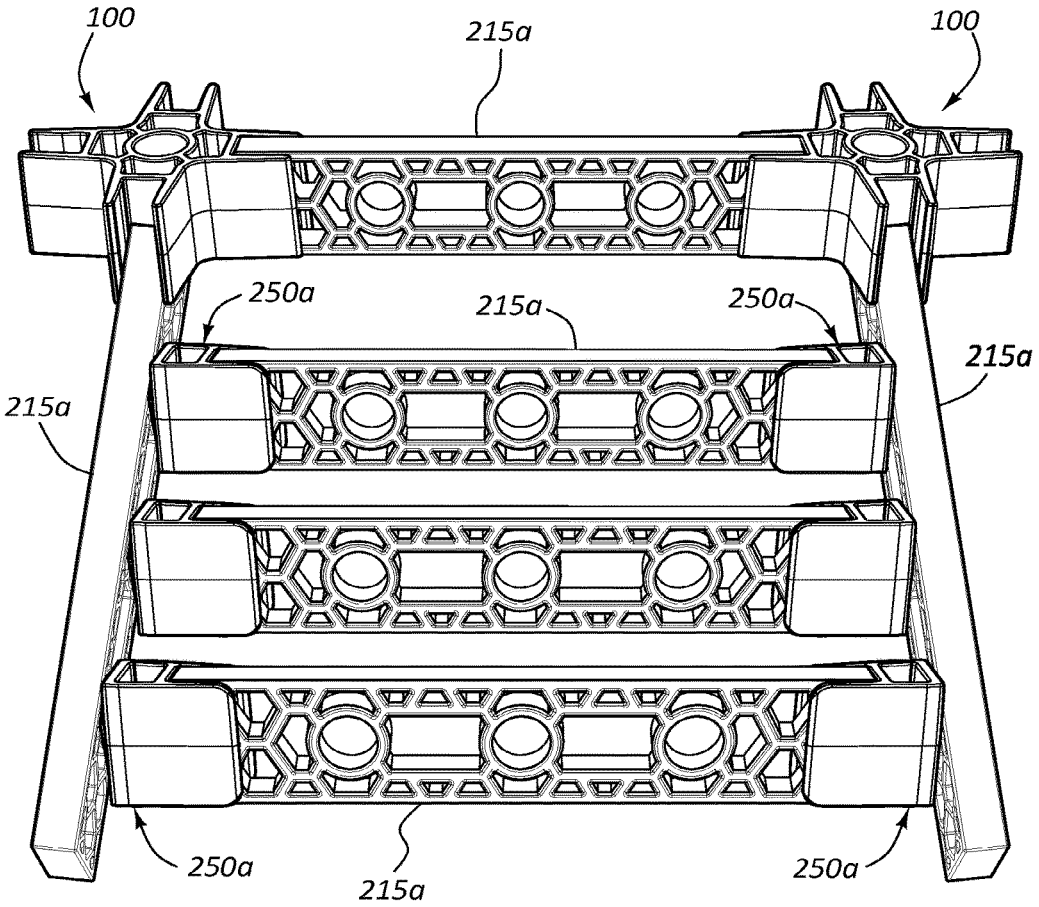
FIG. 18 illustrates additional proportional building characteristics of an embodiment of the present building sets.

As seen in FIGS. 1A-IB, a centrally disposed cylindrical hole 114 may be provided within central body 104. Hole 114 may be open at both ends (e.g., as a tunnel). In another embodiment, one end, or a center of the hole may be closed. Such may be provided relative to any of the contemplated holes 114. A cylindrically configured block may be inserted within hole 114. For example, an axle for a wheeled vehicle may be inserted through illustrated hole 114. Various other connector clips or other accessories may similarly be provided in this way. For example, FIGS. 16-17 and FIG. 18 show how another connector clip (e.g., differently shaped than the clips of FIGS. 1A-3B, referred to by the inventor as "a pivotable hand"), itself including a channel 102, may be coupled into hole 114.

Central body 104 and channels 102 may advantageously be configured to provide independence between the plurality of included channels. For example, insertion of a block into one channel does not substantially interfere with the ability of another channel of the clip 100 to retain a block with substantially the same retention force that would be provided if only a single channel had a block received therein. In an embodiment, at least some of the clips may be generally rigid to ensure independence between adjacent channels. Polycarbonate is an exemplary suitable rigid material for forming such clips. Additional details of the clip 100 are disclosed in U.S. Pat. No. 8,968,046, already incorporated by reference.

Figure 2A:
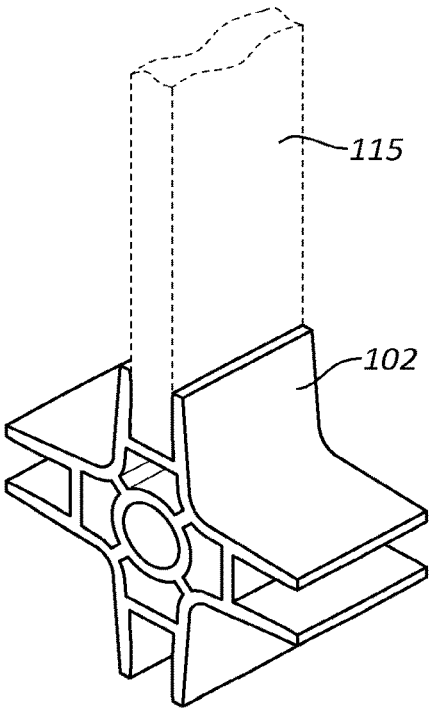
FIGS. 2A-2D illustrate various ways in which a block or plank may be received and retained within a channel of the clip of FIG. 1A.
Figure 2B:
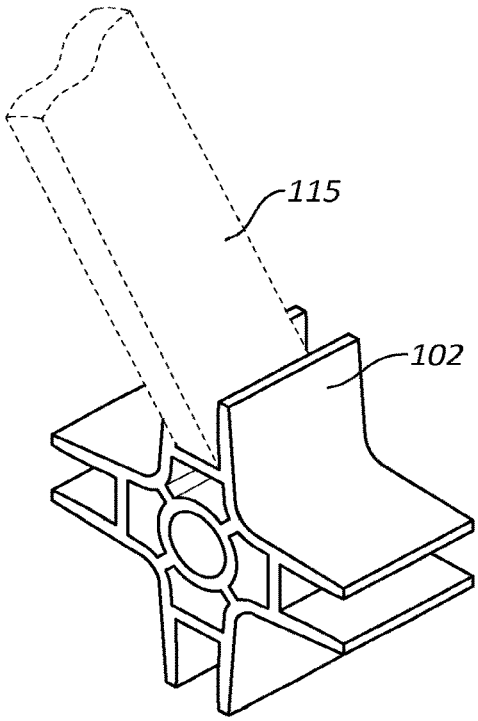
Figure 2C:
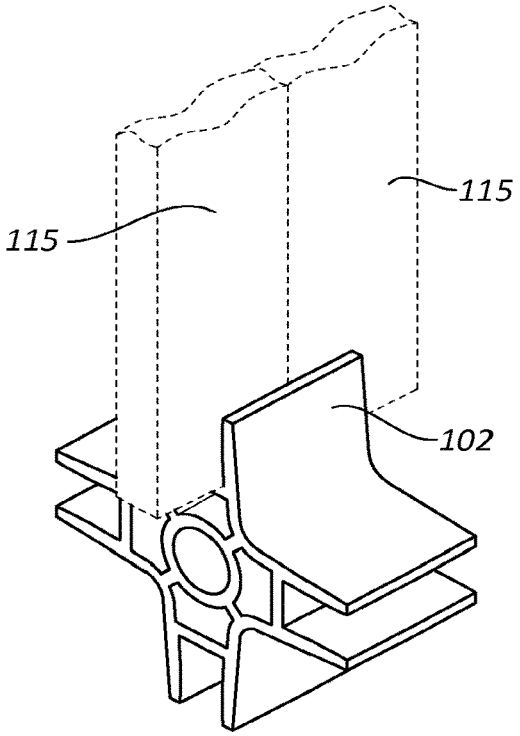
Figure 2D:
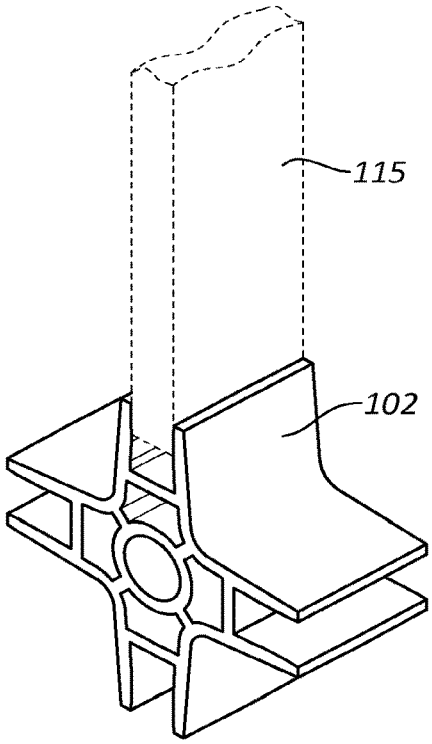

FIGS. 2A-2D illustrate a few ways in which the clip 100 may be used to retain one or more blocks within any of the channels 102. As seen, the connection mechanism is open-ended, rather than binary in nature, so that the block 115 may be coupled in a nearly infinite number of ways and orientations, allowing the builder much more flexibility in building than available with many existing connection mechanisms. For example, a block 115 may be fully seated within the channel 102 (FIG. 2A), it may only be partially inserted (FIG. 2C), it may be slid within the channel, so that part of the block is slid out of the channel (FIG. 2D), it may be rotated to an angle, relative to the channel (FIG. 2B), and multiple blocks may be inserted and retained within the same channel (FIG. 2D). It will be apparent that only partial insertion of the thickness of the block into the channel towards the base defining an interior floor surface of the channel is typically needed to retain the block in the channel (see FIGS. 2B and 2C), and that a plurality of blocks may be received within the same respective channel at the same time (FIG. 2D and even 2B—which includes unoccupied channel space that could accept another block). The block can be rotated within the channel to form a variety of desired angles between the floor of the channel and a side or end of the block inserted into the channel (FIG. 2B). Photographic FIGS. 31-40 included in the priority provisional application show additional features of the open-ended nature of the connection mechanism between the channel of the connector clip and one or more blocks or planks. FIG. 35 shows as many as 4 blocks or planks retained within a single channel (2 on each side). Further description of this open-ended nature is found in the prosecution history of U.S. Pat. No. 8,968,046, also herein incorporated by reference.

In an embodiment, the channels may be smooth—e.g., devoid of any protrusions formed thereon. In an embodiment as shown in the drawings, the interior surface of the channels may be formed of only planar (i.e., no curved) surfaces.

Such connectivity between a block and a channel is not binary—either "snapped" into a corresponding receptacle or not. Because the system is not binary, this allows the building set to provide unique and different building characteristics such as partial or full engagement, ability to rotate the block to any angle relative to the floor of the connection channel, the ability to connect the block into the channel at any location along the length or ends of the block (i.e., "connect anywhere"), the ability to place multiple clips onto a length of the block, and the ability to retain multiple blocks into a single channel, etc. The following describes additional connector clips that are similar to connector clip 100 in that they also include one or more channels 102, providing the same open-ended connectivity between the clips and the channels. These additional connector clips further include additional connectivity features, as will be explained.

II. Pivoting/Rotatable Connector Hubs and Clips

In addition to the basic toy building set that includes one or more connector clips and one or more blocks as described above, additional connectivity and complexity may be provided, while preserving the open-ended play and connectivity benefits through pivotable hand clip connectors, e.g., a connector clip including one or more channels as described herein, but which connector permits rotation or pivoting of the channel. For example, such connector clips may include a hinge or ball joint. This allows rotation of the channel about an axis, while the connector clip is engaged or retained relative to another component of the building set (e.g., a block, another clip, etc.).

Figure 4A:
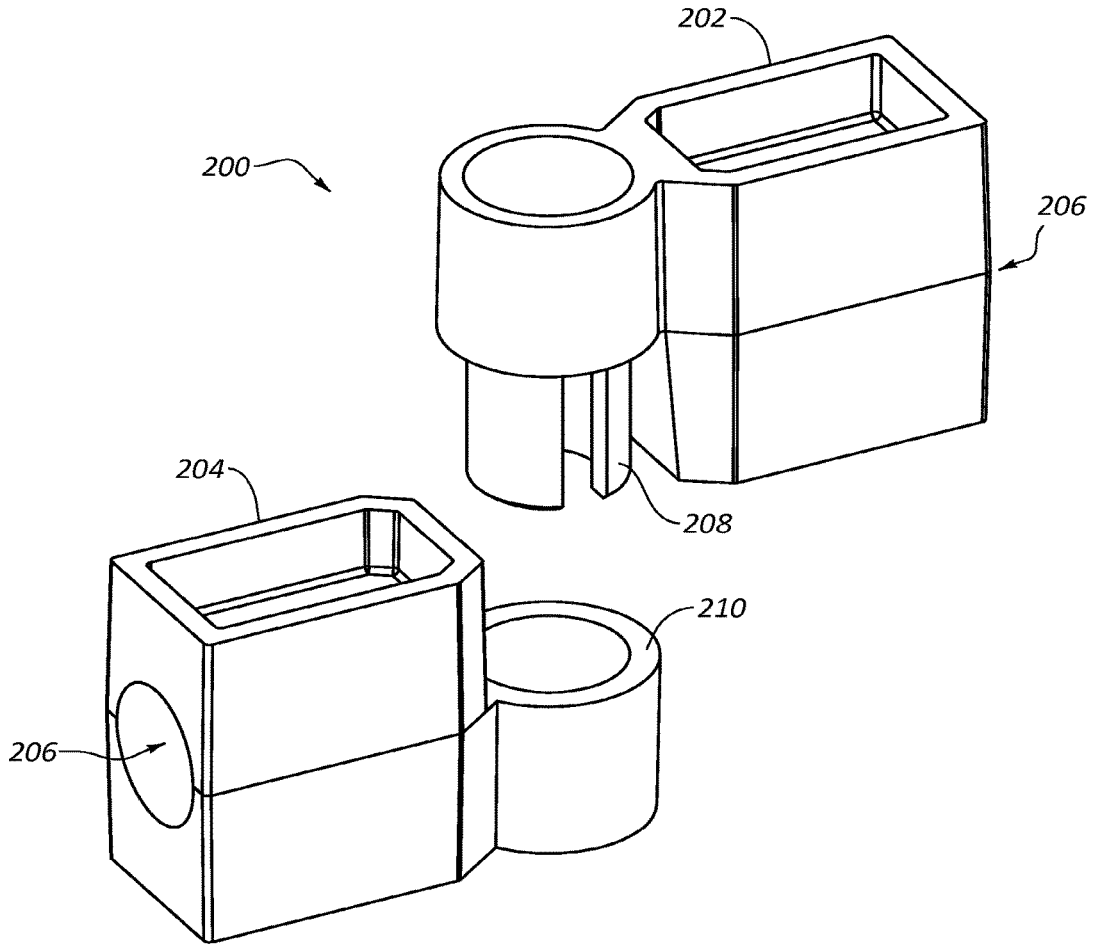
FIGS. 4A-4C illustrate an exemplary hub including two portions that are hingedly rotatable relative to one another, each hub portion including a receptacle for reception of a corresponding connector clip, so that the connector clips may be rotated relative to one another once coupled into the hub.
Figure 4B:
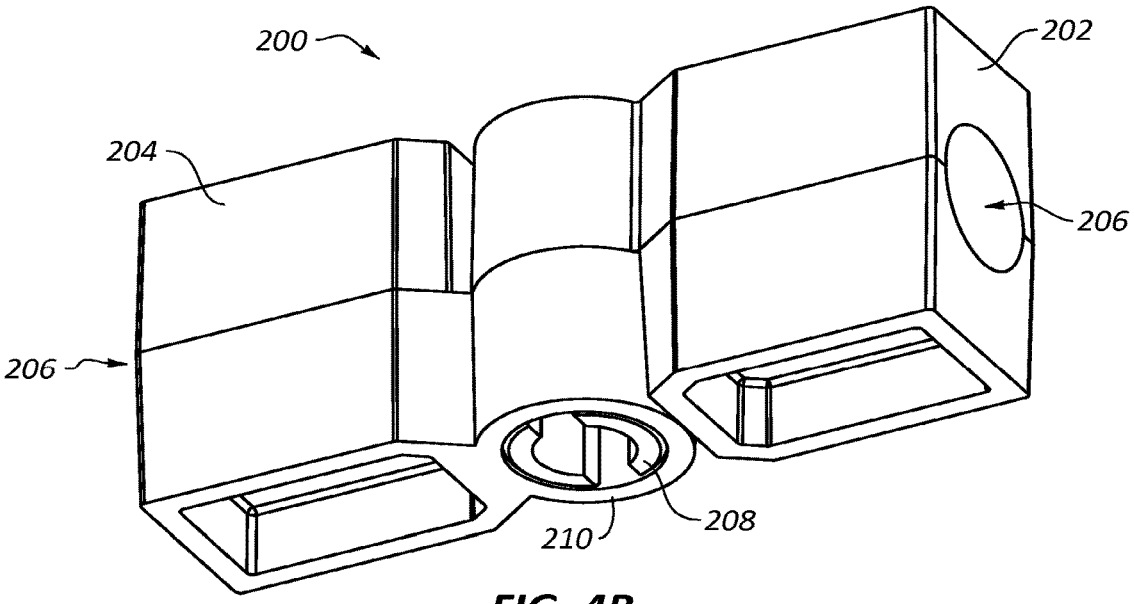
Figure 4C:
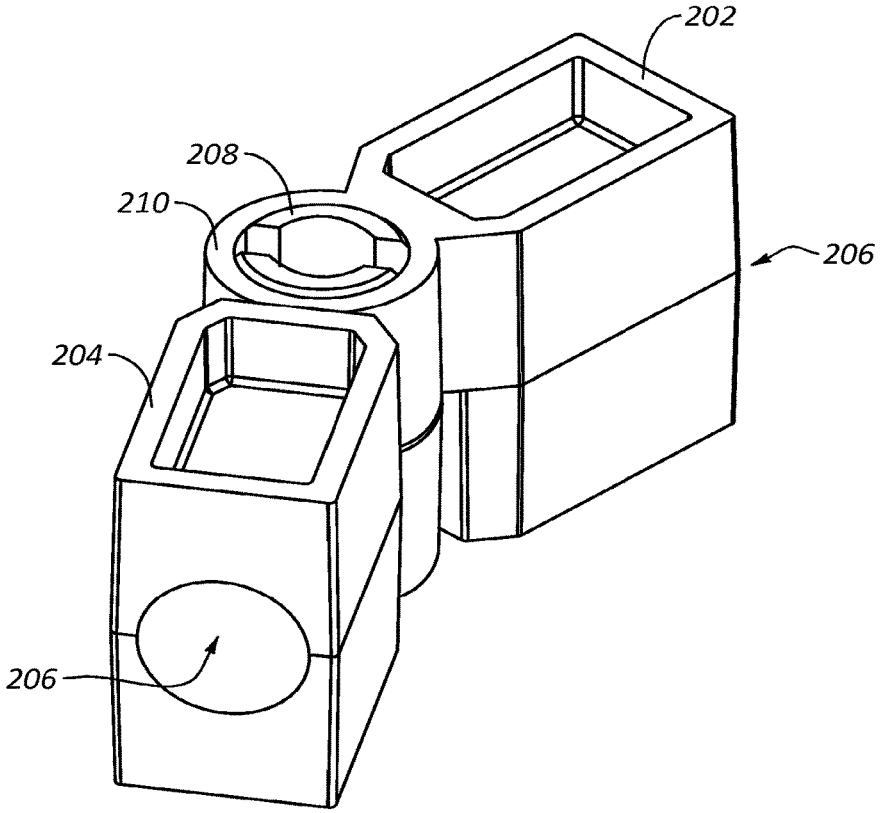
Figure 5A:
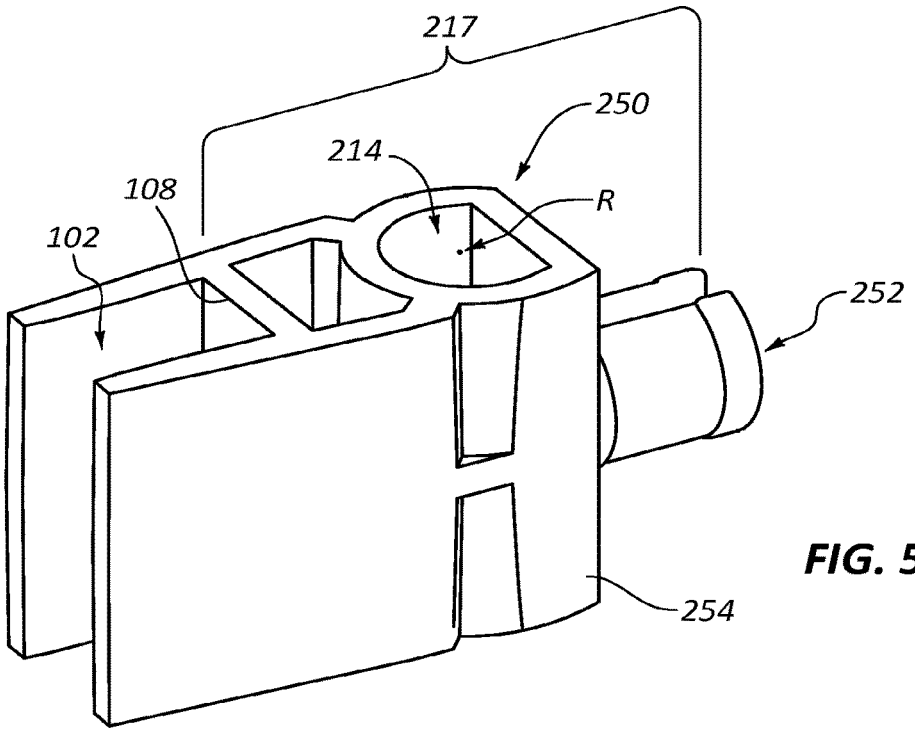
FIG. 5A illustrates an exemplary connector clip for use with a hub such as that of FIG. 4A.

FIGS. 4A-4C illustrate a hub to which one or more connector clips including channel(s) may be connected, allowing for rotation of one portion of the hub relative to the other portion. This allows a builder to select a desired angle between two connector clips (and their channels) that are each coupled to the hub. Hub 200 includes two portions 202 and 204, each with a receptacle 206 into which a connector clip including a corresponding protrusion may be inserted. An exemplary connector clip is shown in FIG. 5A, and another in FIG. 5B. Hub portion 202 may include a shaft 208 over which corresponding sleeve 210 of portion 204 is placed, coupling the hub portions 202 and 204 together. Such a hub allows receptacles 206 to be rotated relatively to one another about the longitudinal axis of shaft 208. Instead of such a cylindrical shaft, it will be appreciated that a ball joint could be provided, allowing rotation of the two hub portions about one another in a latitudinal direction as well (i.e., allowing free movement in two planes at the same time, including rotating in those planes). Receptacles or recesses 206 may be shaped and sized so as to have a diameter equal to hole 114 of connector 100, so that a connector clip is compatible for use with both. The terms receptacle and recess may be used interchangeably relative to such structures of a hub.

FIG. 5A illustrates a connector clip 250, including a channel 102 for connectivity with a block or plank as described herein relative to connector 100. A mating protrusion 252 (e.g., a pin, split horizontally, vertically, or otherwise) may be provided, also extending from body 254 of the connector clip, for insertion and retention into hole 114 or receptacle 206 of another connector (e.g., 100) or hub (e.g., 200), respectively. Where hole 114 or receptacle 206 and the protrusion 252 are both cylindrical, clip 250 may be rotated within the hole or receptacle to any desired position, orienting channel 102 as desired. Of course, placement of a hinge or ball joint between such a connector (e.g., 100) or hub and clip 250 would allow further freedom in orienting channel 102.

Figure 5B:
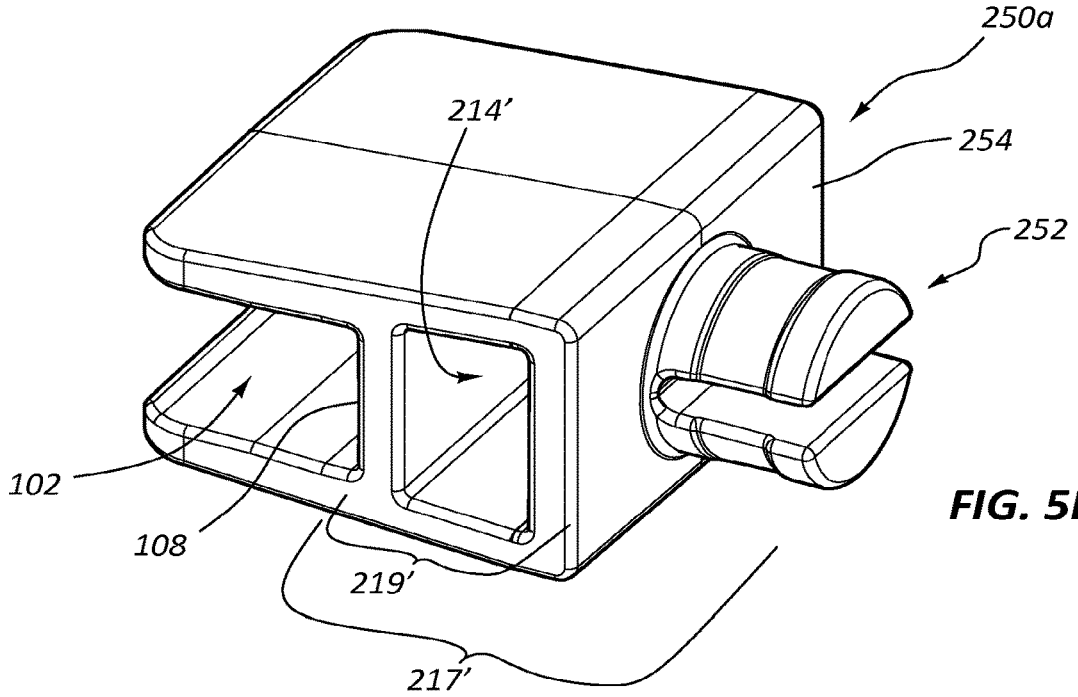
FIG. 5B illustrates another exemplary connector clip.

FIG. 5B illustrates a similar connector clip 250*a* including a channel 02, and a mating protrusion 252. Clip 250*a* is similar to clip 250, but somewhat shorter in length (it is missing the tunnel between channel floor 108 and hole 214', providing different proportionality characteristics, as will be explained in further detail herein.

Figure 6A:
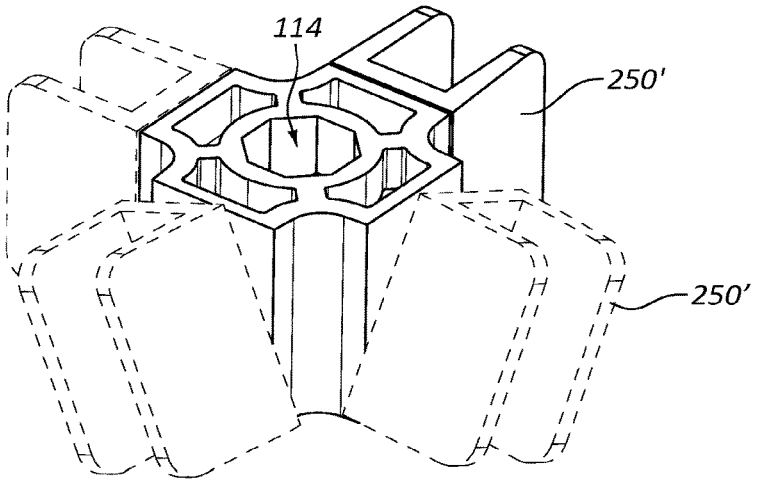
FIGS. 6A-6B illustrate another exemplary hub, showing connection and rotation of connector clips within receptacles of the hub to various orientations.
Figure 6B:
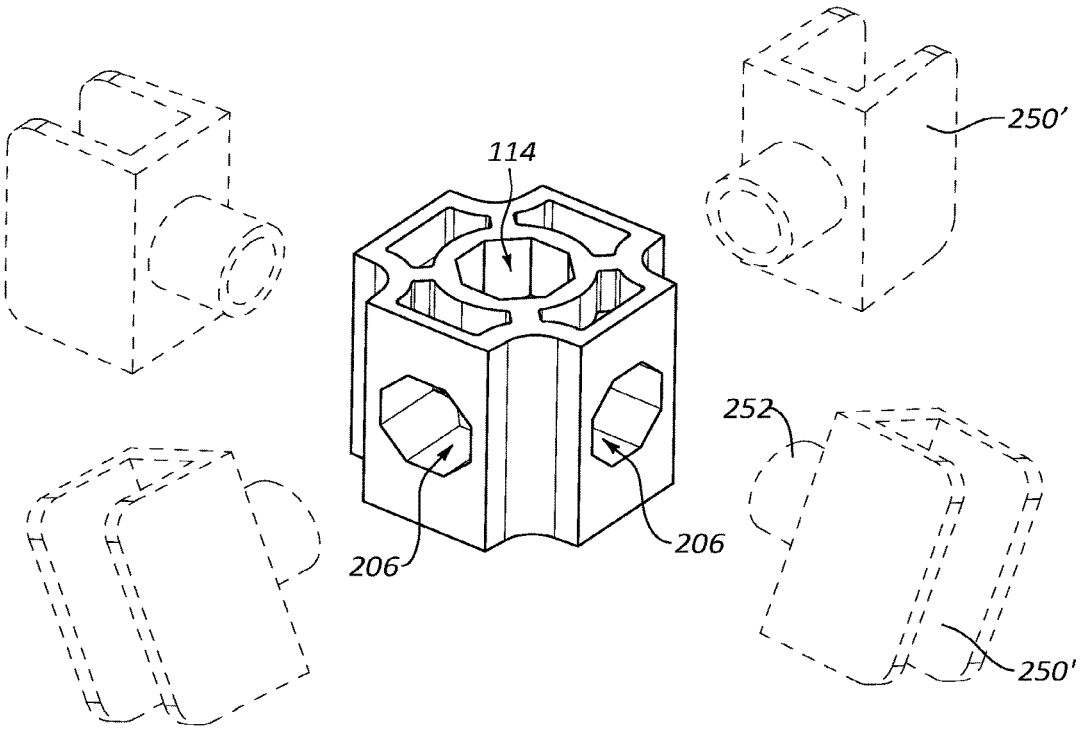

Another exemplary hub (a sort of rectangular or square hub including 4 faces plus top and bottom faces) is shown in FIGS. 6A-6B. Although the receptacles 206 are shown as being polygonal (e.g., 8 sides, 6 sides, etc.), it will be appreciated that they may alternatively be formed so as to be circular in cross-section (i.e., cylindrical). Even with a polygonal receptacle, as seen in FIG. 6B, cylindrical protrusions 252 may be received and retained upon insertion into the receptacle. Holes 114 of hub 200 may similarly be polygonal, or circular in cross-section, and may similarly serve to receive a mating protrusion of a connector clip, as do receptacles 206. In another embodiment, protrusions may be formed to include a polygonal cross-section, so as to mate shape wise relative to the receptacle (e.g., both protrusions and receptacles being octagons of corresponding size, etc.). Such a mechanism would prevent rotation of the clip within the receptacle, and allow its orientation to only one of the given 8 (or 6 or however many sided polygon is used) rotated, indexed orientations. Circular cross section in at least one of the mating structures provides infinite variability in orientation, and the ability to rotate the connector clip while inserted into the receptacle.

Figure 6C:
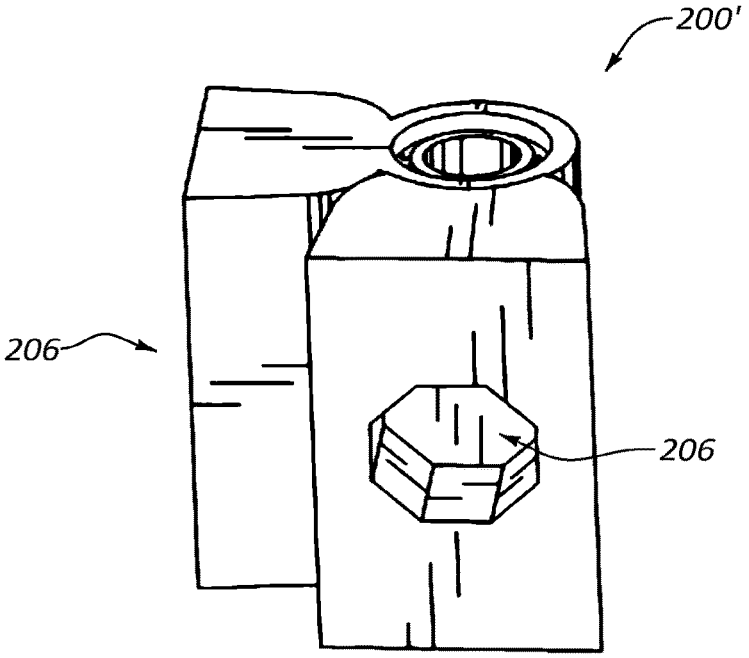
FIGS. 6C-6D illustrate another exemplary hub, similar to that of FIGS. 4A-4C, which may include two receptacles that can be rotated relative to one another.
Figure 6D:
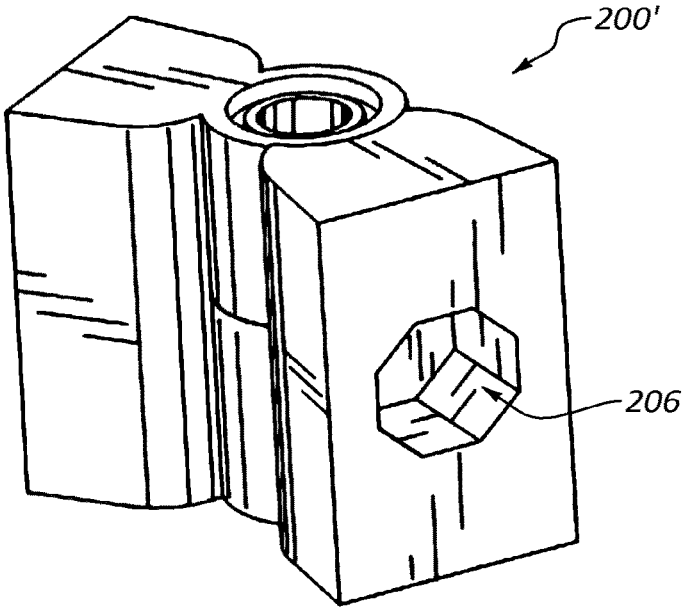
Figure 7A:
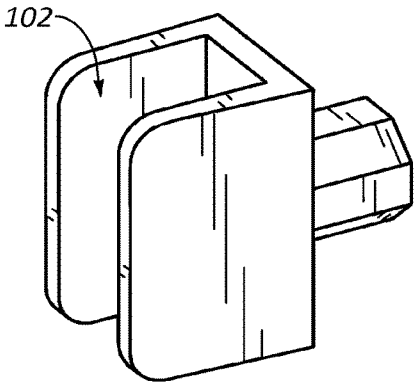
FIGS. 7 A-7D illustrate various other exemplary connector clips (e.g., interchangeable with that of FIG. 5) that may be coupled within a receptacle or hole of a hub or connector clip.
Figure 7B:
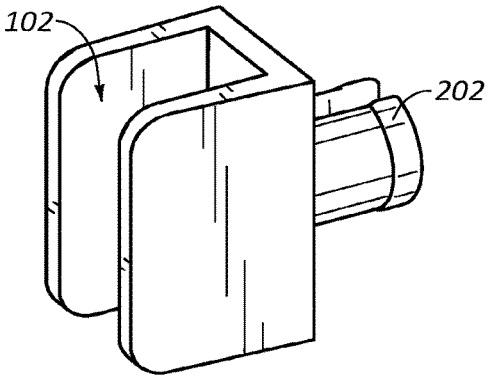
Figure 7C:
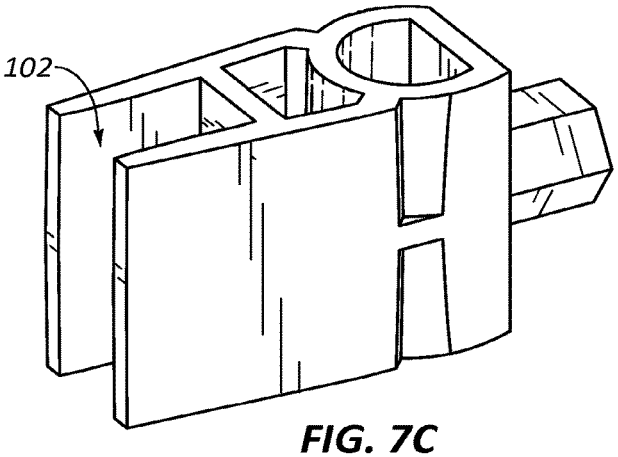
Figure 7D:
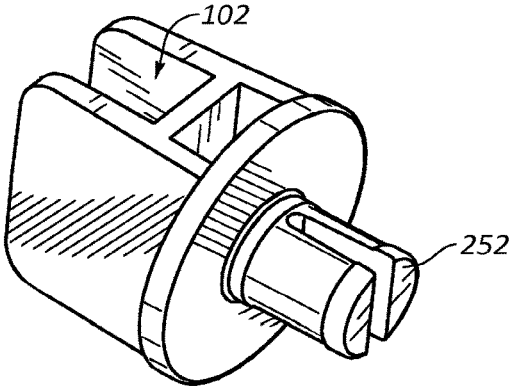

FIGS. 6C-6D illustrate another hub, similar to that of FIG. 4A, which allows a mating protrusion 252 to be inserted into receptacle 206 (e.g., either polygonal or circular). FIG. 6D shows the two portions of hub 200' rotated to a different angle between the two receptacles 206 (e.g., about 90° versus perhaps about 120°)

FIGS. 6A-6B also illustrate an alternative connector clip configuration 250' usable with any of the hubs. A mixture of different connector clip configurations (e.g., 250 and 250' could of course be connected to a single hub. Various alternative exemplary connector clips for use with a hub or other connector clip (e.g., clip 100) are shown in FIGS. 7 A-7D, as well as FIGS. 5A-5B, already described. Each includes a channel 102 (e.g., for reception and retention of a block or plank) and a mating protrusion to be received within a receptacle of a hub, or similarly shaped and sized hole or tunnel of a connector, such as connector 100. It will be apparent that various other configured connector clips including a channel and mating protrusion could be used (e.g., even including an angle other than 180° (e.g., 90°, 60°, 45°, 30°, etc. between the mating protrusion and channel).

Figure 8A:
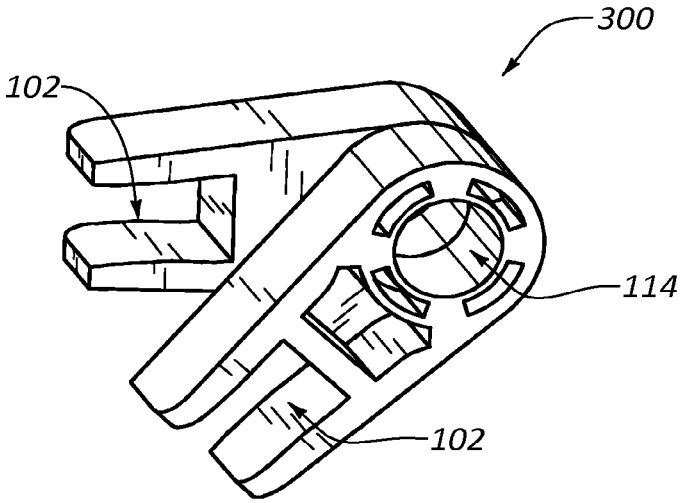
FIGS. 8A-8B illustrate another connector clip, including two channels that may be pivoted relative to one another.
Figure 8B:
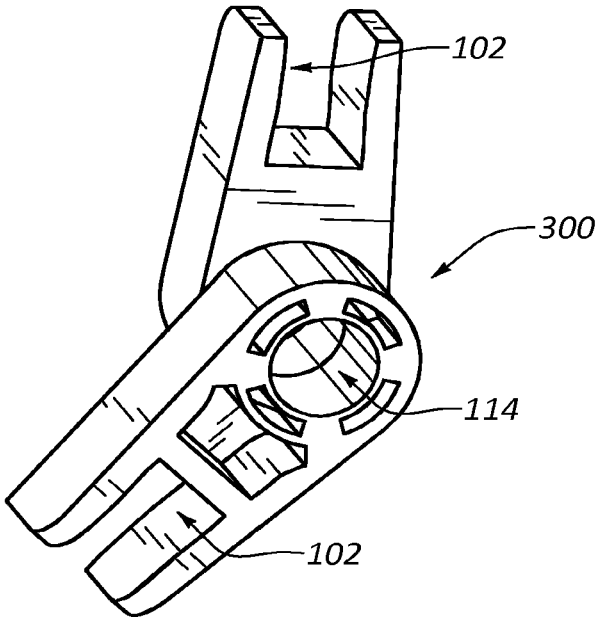

FIGS. 8A-8B illustrate another configuration of a connector clip 300, which includes two portions that are hingedly connected to one another. A hole 114 is provided (e.g., a tunnel that may pass entirely through both portions), into which a mating protrusion of another connector clip (e.g., any of those of FIG. 5A-5B, 6A-6B, or 7A-7D) may be received. Each portion is further shown as including a channel 102, which channels 102 may be rotated relative to one another (compare the angles between the channels in FIGS. 8A and 8B), which channels may receive and retain a block or plank.

Such pivoting or rotatable connectors and/or hubs allow a builder to put the channel of a given connector clip in orientations and/or positions that is not possible with the basic building system. For example, the builder can twist the channel to be oriented in a desired orientation to as to be able to receive a plank or block. Such components further increase the possibilities of open ended play possible with the building sets, creating many possibilities for the builder. Such a connector clip 300 does not necessarily include a receptacle or mating protrusion, but already incorporates a plurality of channels (e.g., two) in a rotatable arrangement relative to one another.

Figure 8C:
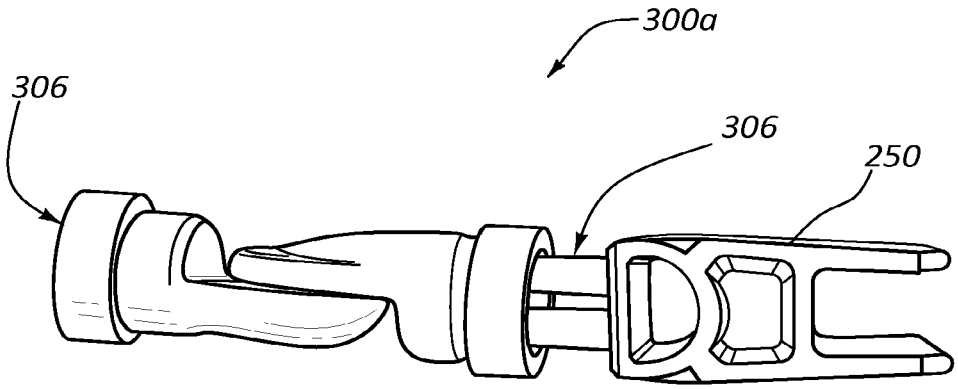
FIGS. 8C-8D illustrate exemplary hinged hubs that may be included within contemplated building sets.
Figure 8D:
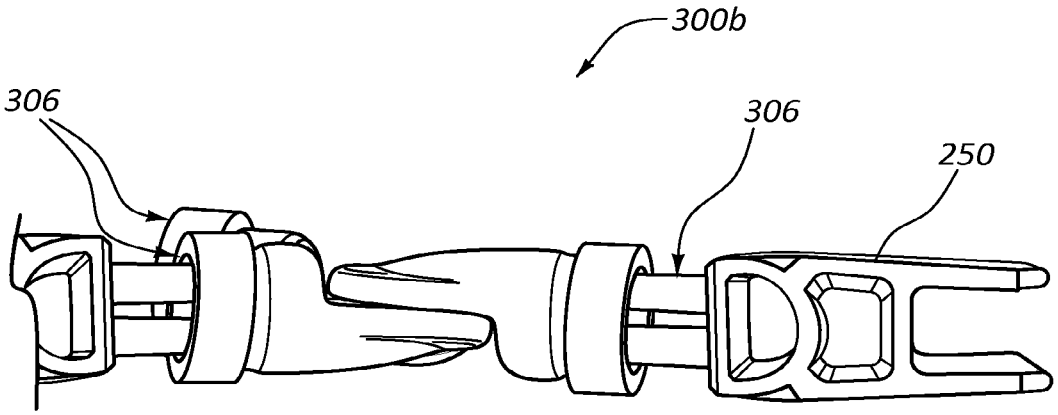

FIGS. 8C-8D illustrate another hinged hub for use with connector clips 300*a* or 300*b* that may be included with the present building systems. For example, any of the described hinged and/or rotatable hubs or connector clip structures provide for numerous ways for a builder to solve a length and/or angle connectivity problem (e.g., to connect between two already existing structures having a given position and geometry). Such a hub may take the form of a 2-way or 3-way elbow (or even a 4-way elbow). FIG. 8C shows a 2-way elbow 300*a*, although it will be appreciated that two receptacles may be provided on one side of the hinged elbow hub, providing a 3-way elbow, as shown in FIG. 8D. Each of the arms of the elbow may include a receptacle 306 into which a mating protrusion 252 of any clip (e.g., clip 250) may be inserted.

III. Planks with Holes and/or Male-Female End or Side Connectivity

Figure 9A:
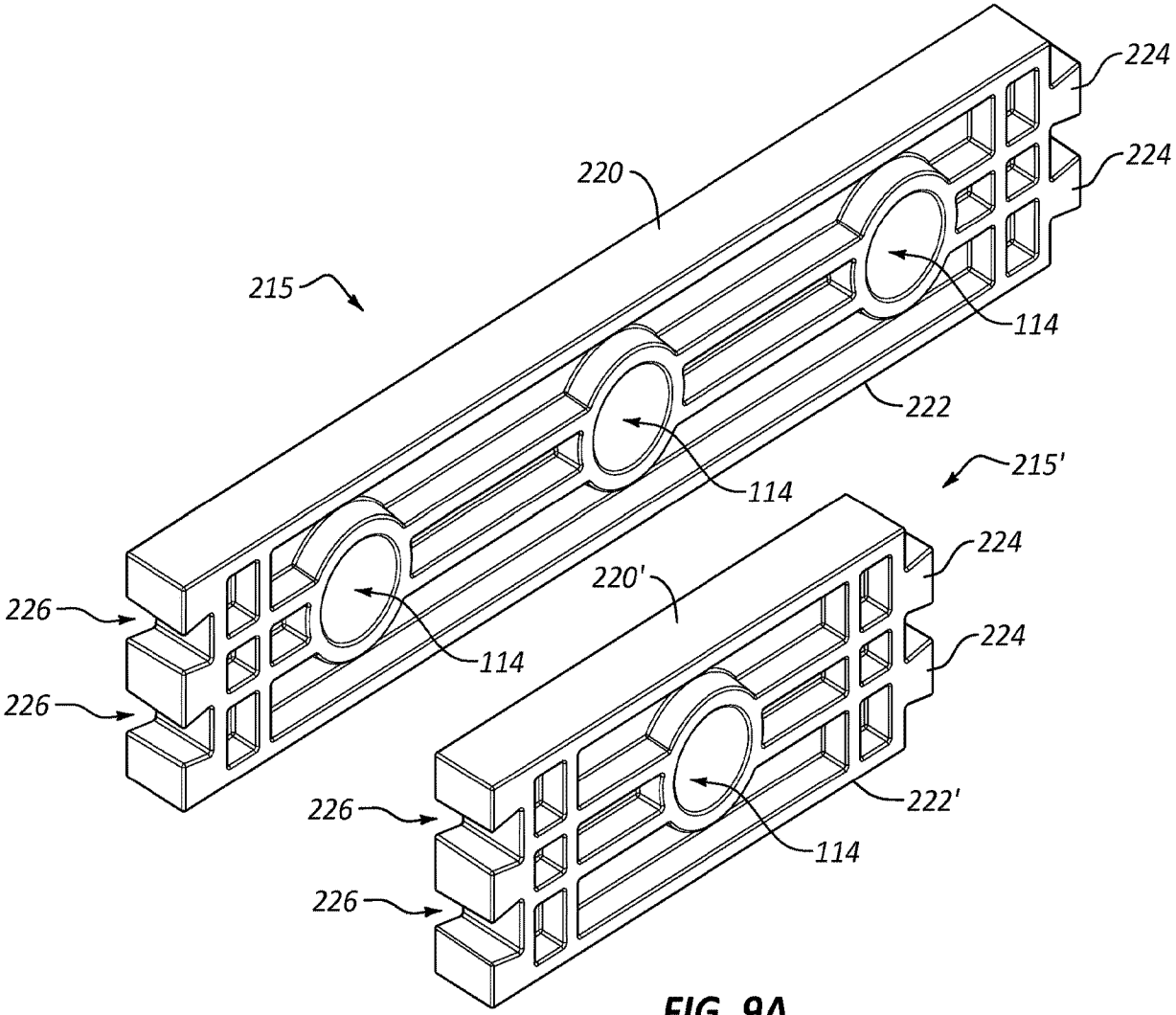
FIG. 9A illustrates a plurality of proportional length planks that may be included within the present building systems.

FIG. 9A shows exemplary planks 215 and 215'. Plank 215 may be similarly sized relative to planks 115 (e.g., see FIGS. 2A-2D), but are shown as including mechanisms allowing additional connectivity of other planks or other components with the plank. For example, plank 215 may include one or more holes 114 having the same diameter as other holes 114 shown with respect to other components of the building system, so as to allow reception and retention therein of any of the mating protrusions (e.g., 252). It will be apparent that protrusion 252 may be rotated within hole 114, so that the connector including protrusion 252 may be rotated to any desired angle within hole 114. As shown in FIG. 9A, holes 114 may be centrally disposed (e.g., aligned with a central longitudinal axis of plank 215), equally spaced from the opposing sides 220 and 222 of plank 215. In a plank 215 as seen, one hole 114 may be disposed at the center of plank 215, with another two holes 114 disposed on either side thereof, equally spaced apart relative to one another.

Plank 215 may include one or more dovetail or other protrusions 224 at one end thereof, and one or more dovetail or other recesses 226, at the opposite end. Dovetail protrusions 224 and recesses 226 are aligned with one another, so that if another plank 215 were placed end to end relative to illustrated plank 215, the recesses 226 or one plank would mate with the protrusions 224 of the other plank. Although illustrated with dovetail protrusions and recesses that correspond and mate with one another (i.e., the protrusion fits within and fills the corresponding recess), it will be appreciated that other complementary, correspondingly shaped protrusions and recesses (i.e., male-female connections) may alternatively be employed. The opposite face of each plank 215 and 215' may appear identical to the illustrated face. In addition, while shown including protrusions and recesses for connecting the planks end-to-end, it will be appreciated that such male-female connecting structures may be provided on the sides (e.g., 220, 222, or 220', or 222'), allowing two planks to be connected side-by-side.

Plank 215' is shown as shorter in length than plank 215. In an embodiment, two of planks 215' coupled together may be equal in length to plank 215. Such proportional building characteristics provide distinct building advantages, as will be further described below. Plank 215' is shown as similarly including dovetail protrusions 224 and dovetail recesses 226. A single hole 114 is shown provided, centrally disposed within plank 215', central relative to both sides 220' and 222', as well as centrally disposed along the length of plank 215'.

In an embodiment, when two planks 215' are coupled together (to equal the length of plank 215), the two holes 114 of planks 215' may be aligned (with respect to the length of plank 215 and the end-to-end two planks 215') with one another, so that one could run a cylinder, axle, or similar through aligned holes 114 of plank 215 and the composite plank formed of two planks 215'. It will be apparent that in such an embodiment of plank 215', hole 114 would not be disposed centrally relative to the length of the plank, i.e., it would be closer to recesses 226 than protrusions 224. The corresponding plank that would be coupled thereto would include a hole that is similarly closer to protrusions 224 than recesses 226, so that a composite plank equal in length to plank 215 (formed of two half-length planks 215') would include two holes 114, aligned with outer holes 114 of plank 215.

While shown with protrusions 224 and recesses 226, it will be appreciated that in another embodiment, no such connecting protrusions or recesses may be provided (e.g., but still with holes 114).

Such planks may similarly be coupled into any channel 102 of any of the connector clips. Those connector clips including a cylindrical protrusion 252 may similarly be received within any of holes 114. Such a connector clip (e.g., connector clip 250 of FIG. 5) could be rotated within any of holes 114 of a desired plank, to orient channel 102 at any desired angle, so as to be coupleable to another plank.

Figure 9B:
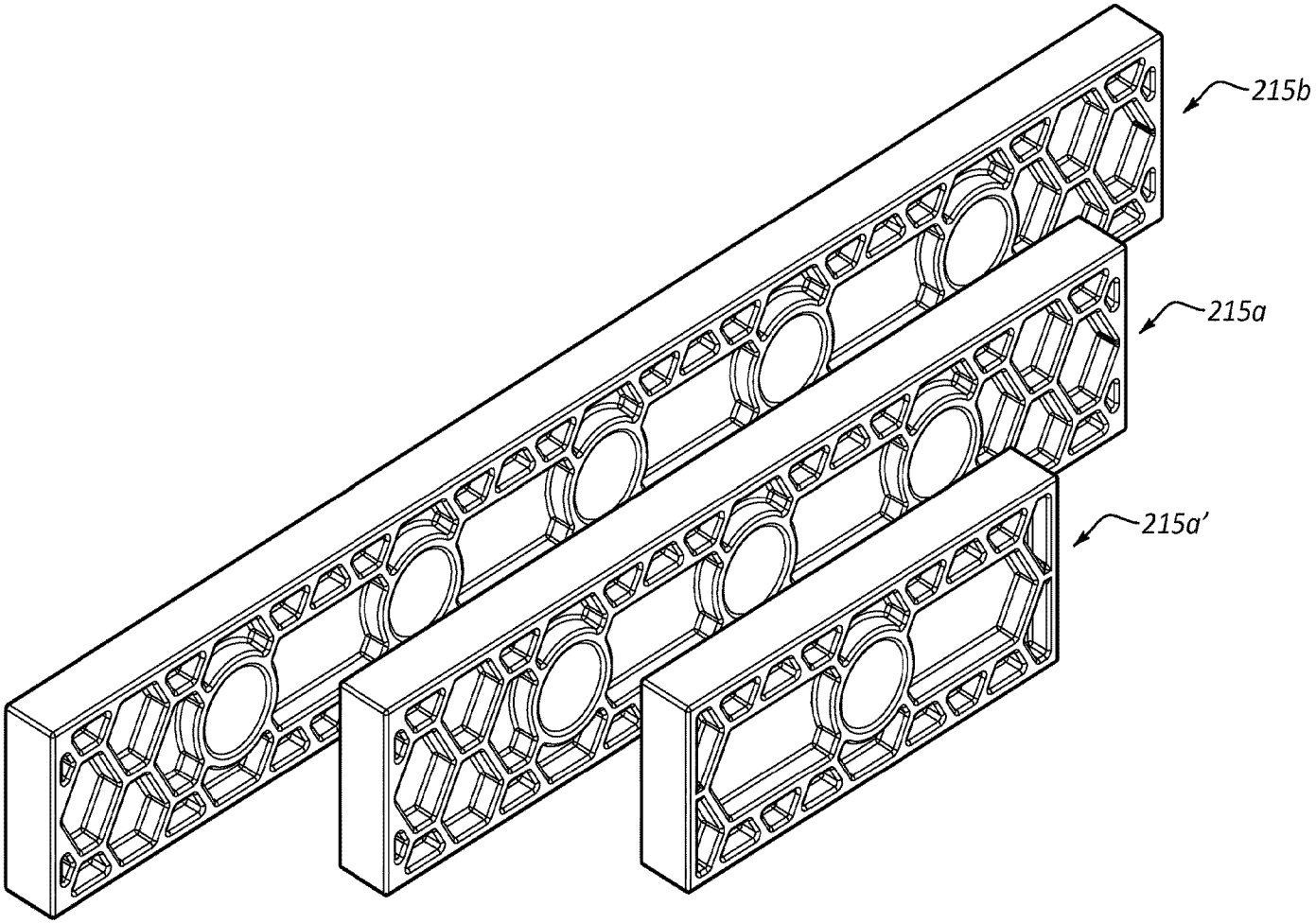
FIG. 9B illustrates a plurality of proportional length planks similar to those of FIG. 9A, but somewhat differently configured.

FIG. 9B shows planks 215*a* (two units in length) 215*a'* (one unit in length) and 215*b* (3 units in length), similar to planks 215 and 215', but without mating protrusions and recesses, and having a different internal rib pattern. It will be apparent that various internal rib patterns (or no such ribs) are possible. An internal rib pattern may be particularly preferred where the planks are not formed from wood, but from a plastic material. Such ribbed patterns conserve the plastic material (i.e., less material employed to form a given plank).

In an embodiment, the planks or blocks may be rigid. For example, where formed by wood, the blocks and planks may be rigid. While shown in flat configurations, curved (rigid curved, or flexible curved) configurations are also possible. Where formed from other materials, the planks may be relatively more flexible. For example, flexible planks may be used to create congruent or parallel rails for ball runs, marble runs, tracks for vehicles, etc. Such planks may extend through any desired pathway, remaining an equal distance apart from one another (i.e., similar to railroad tracks, to be parallel, or in other words congruently aligned a same distance from one another across the pathway).

Figure 9C:
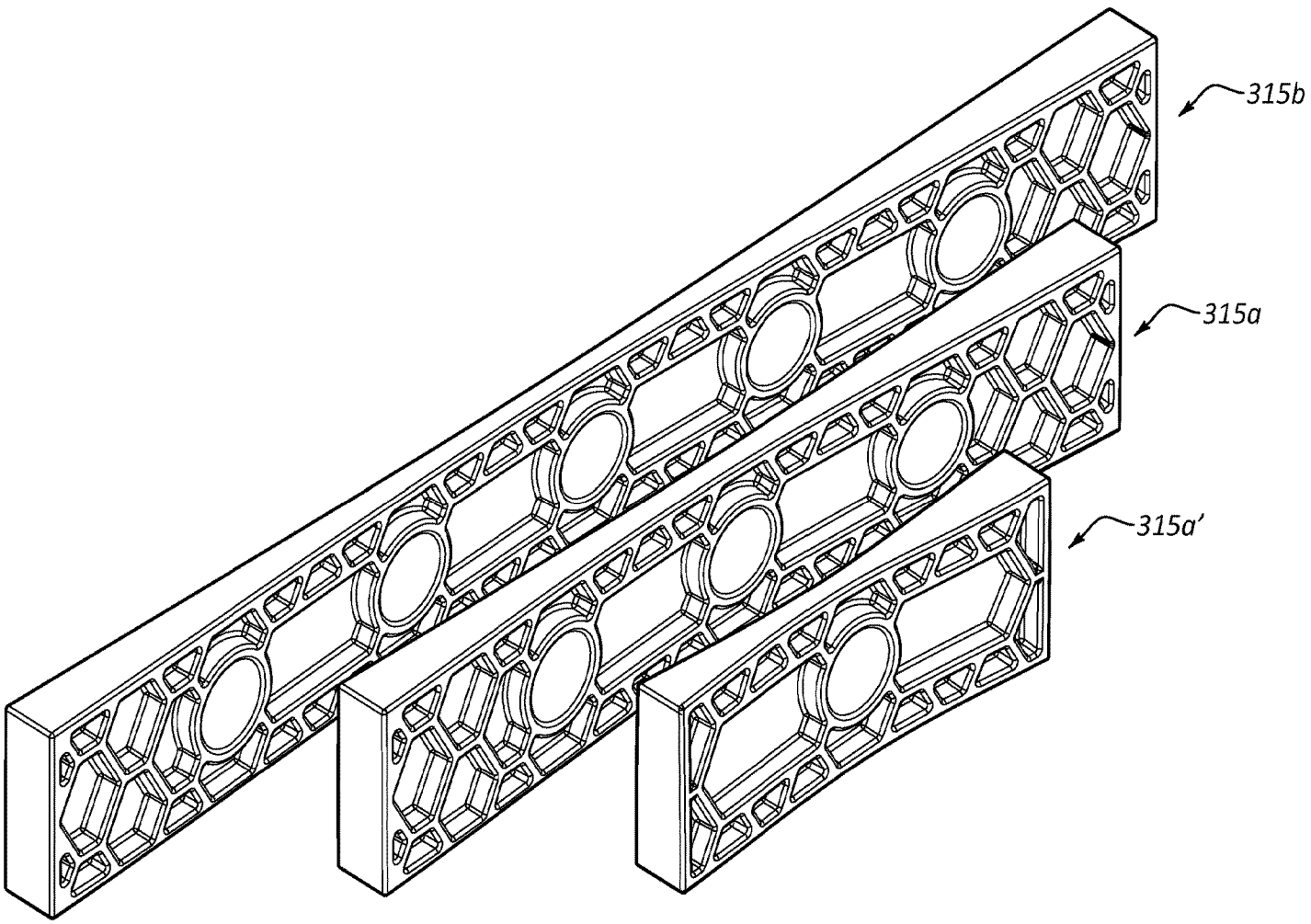
FIG. 9C illustrates an exemplary flexible plank.

Planks formed from materials other than wood may be flexible as a result of the material selection, and or geometry of the plank. In order to increase flexibility, planks (e.g., planks 315*b*, 315*a*, and 315*a'*) may be formed to be relatively thinner at the plank's center portion, thickening towards the ends, as shown in FIG. 9C. While shown without male-female connections, it will be appreciated that any such may be provided, e.g., as described herein (e.g., with any of the planks shown herein). Suitable plastic materials for plank formation may include various polyolefins, such as polypropylene (PP), polyethylene (e.g., HDPE), as well as silicone and/or urethane flexible and/or elastomeric materials. Silicones and urethanes may be relatively more flexible than the basic inexpensive polyolefins, such as PP and PE. The flexibility of planks made from such materials may be adjusted by thinning portions of the plank cross-section. In an embodiment, the outer edges (sides 220, 222, and the ends) may remain of the desired thickness (e.g., 8 mm) to be engaged within channels 102, even while the center interior portions of such planks may be thinned for increased flexibility.

IV. Proportionality Characteristics of Building Set

Figure 13:
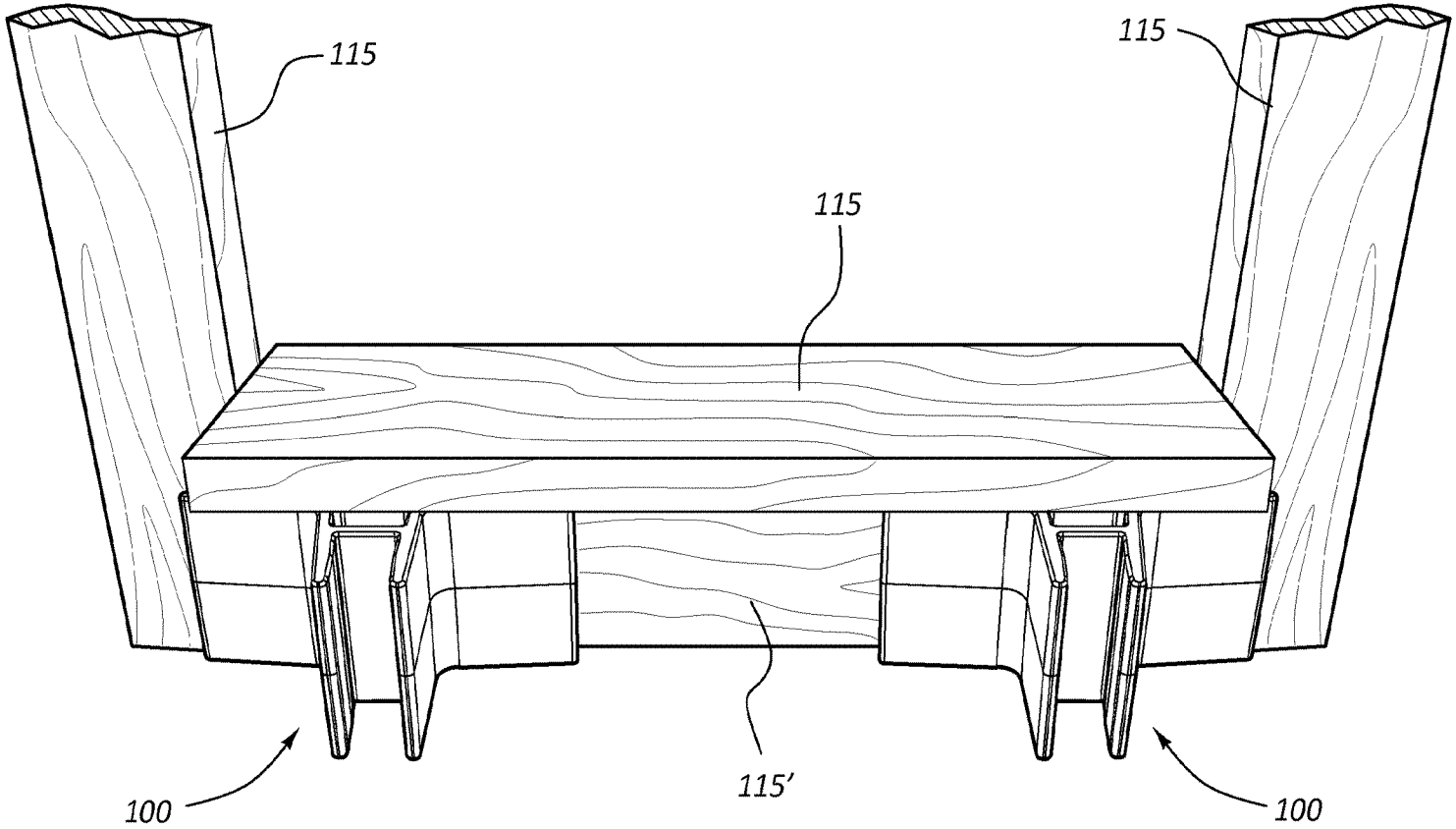
FIGS. 13-15 illustrate proportional building characteristics of an embodiment of the present building sets.
Figure 14:
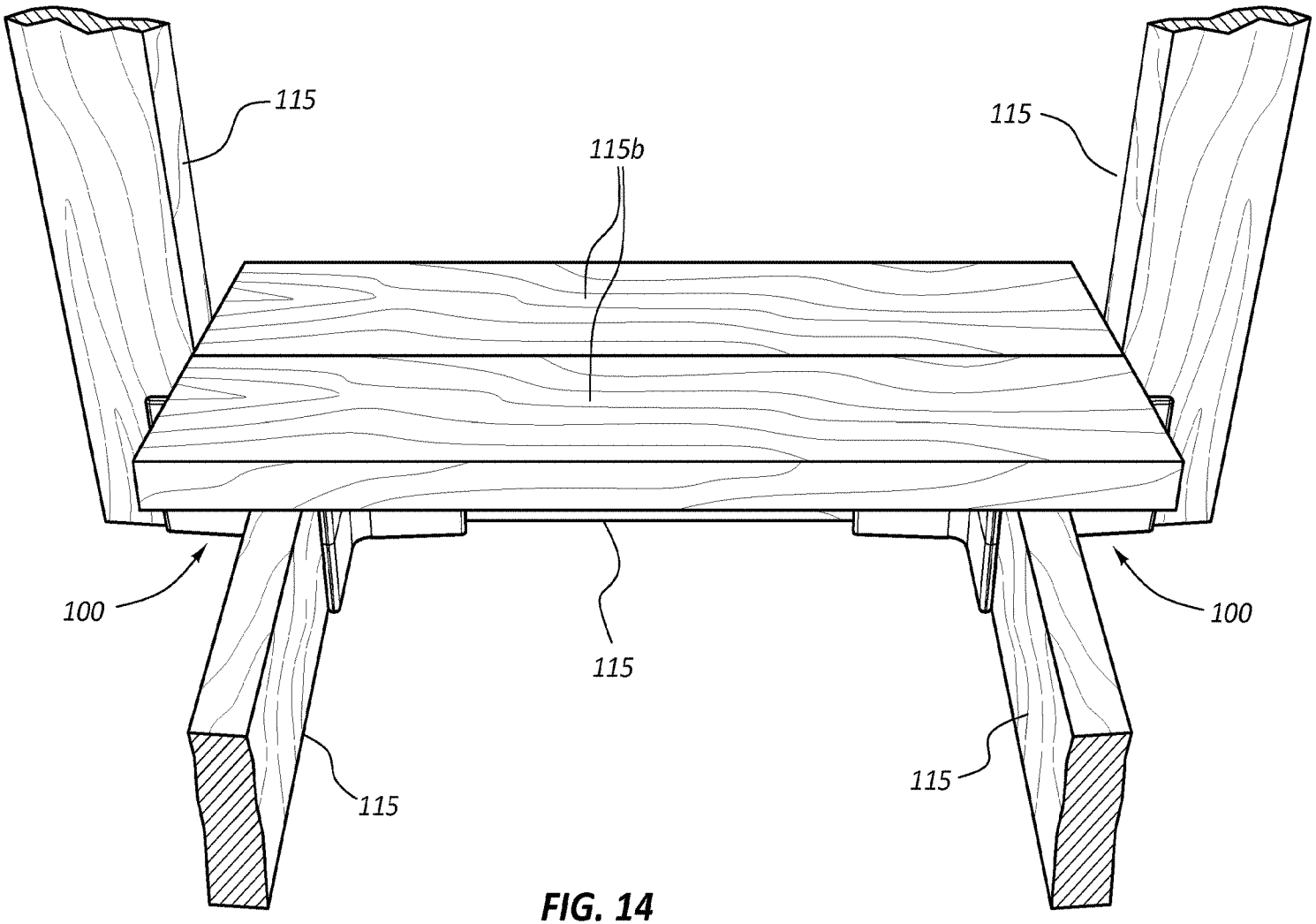

The connector clips (e.g., connector clip 100 including channels 102 spaced 90° apart, the insertable "pivotable hand" of Figure SA, etc.) may be configured with specific proportional characteristics relative to one another, and relative to the planks or blocks. For a proportional building system, the half-length plank (e.g., plank 215', 215*a'*) may be based on a length of about 2⅜ inches in length. This length could be referred to as a "unit". For example, planks may be provided in lengths of one unit, two units, three units, etc. Connector clip 100 of FIGS. 1A-ID may be configured with a distance from one floor 108 of a given channel 102 to the floor 108 of the opposite channel 102 (i.e., channels that are 180° apart from one another) that is half the length of the half-length plank (i.e., half of 2⅜ inches—or half a "unit"). This proportional dimension is clearly referenced as distance 117 in Figure ID. As a result, if a builder has two connector clips 100 with a half-length (i.e., 1 unit) plank 215' or 215*a'* disposed therebetween (seen in FIG. 13), the length of the resulting connected structure from the floor 108 of one clip to the opposite floor 108 of the other clip is 4⅝ inches, equal to the length of a full length plank 215 (or block 115), i.e., two "units". As a result, a full length plank or block (215 or 115) 4⅝ inches in length can fit across (and fully span) the half-length plank or block 115' plus the applicable length of the two connector clips exactly, allowing another plank or block to be engaged in the far side channels of both connector clips, as seen in FIG. 13. Such could be used as bridge planking, as shown in FIG. 14. This allows for outer beams and walls to be built, while just fitting a plank 2⅜ inches (one "unit") longer between the vertical beams or blocks 115. Of course, it will be appreciated that the proportionality features of the building system may be based on a different actual length for one "unit" (i.e., other than 2⅜ inches equal to one "unit). The length of the planks may vary somewhat, although they should be consistent one with another (e.g., 4⅝ inches in length for a two "unit" plank—a unit may be closer to 2⁵⁄₁₆ inches). All values described herein based on a given value for a "unit" may readily be scaled by one of skill in the art to another length for a "unit".

Figure 15:
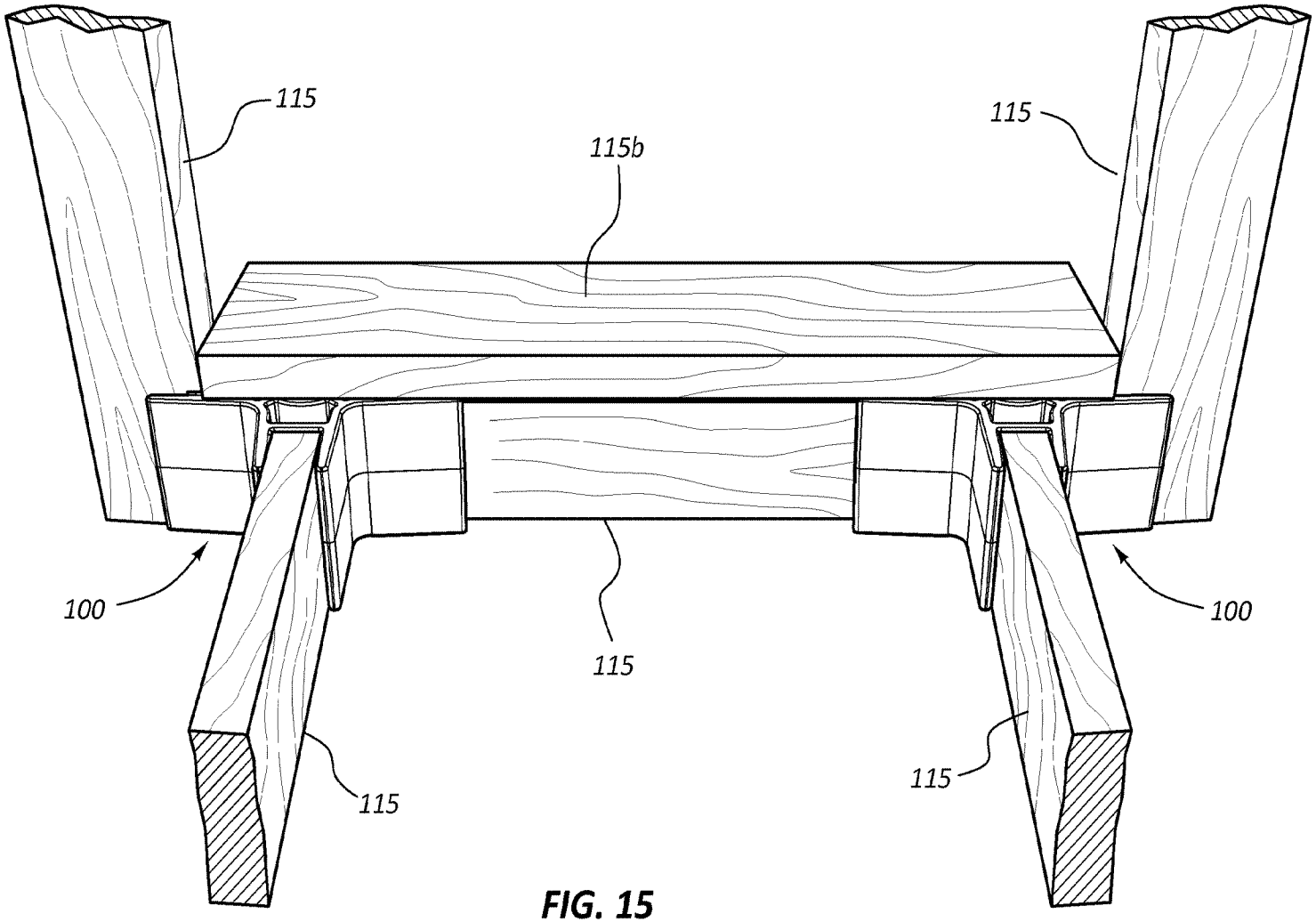

If the length of a plank is increased by 2⅜ inches (i.e., by one "unit"), thereby using a 4⅝ inch long plank (i.e., a two "unit" plank) and a 7⅛ inch plank (a three "unit" plank), the same building pattern can be achieved, because the connection distance from the floor of one channel to the floor of the opposite channel makes up the difference between the two "unit" and three "unit" planks (115 and 115*b*, respectively). This is shown in FIGS. 14-15. Thus, according to one embodiment, the planks are proportional to the connector clip in that a plank "unit" length (e.g., a half-length plank) is equal to two times the distance floor to floor (117 in Figure ID) between oppositely disposed channels. Thus, two connectors in an end-to-end in line structure (as seen in FIGS. 13-15) would include a total connector length between the floors of the connectors (on either end of the connected structure) that is equal to half the length of a two "unit" plank (or equal to a length of a one "unit" plank, i.e., 2⅜ inches).

FIGS. 16-17 show planks in a vertical orientation, illustrating another feature of such proportional building systems. The same principal applies, but with a different purpose. A typical building pattern is to put a plank (e.g., 115*b*) vertically half-way into the connector channel 102 (i.e., fully seated but only half of the length of the channel being occupied as shown in FIG. 16). The plank may be placed half-way into two connectors 100, one at top and one at bottom. This half-way insertion allows the builder to then build up and then either up (or out) again from the same connector (as half of the channel of the top and bottom connector clips is empty, and could accommodate another plank).

Using the one "unit" (e.g., 2⅜ inch) amount, split in half such that this distance spans halfway into the channel, and then up to a floor where a plank one "unit" (e.g., 2⅜ inches) long is seated, then repeated on the upper end, we get a distance that matches a plank that is one "unit" (2⅜ inches) longer (these could be any length as long as they are one "unit" longer than one another) put half way into the channel 102. This means that the shorter plank (e.g., plank 115 in FIG. 16) plus two pivotable hands 250 (e.g., the connector clip of Figure SA) spans the same distance as the next longer (by one "unit") plank (plank 115*b*) put half-way into the channel of the clip. In FIG. 16, this is shown with a two "unit" plank 115, and a three "unit" plank 115*b*. FIG. 17 shows this with a one "unit" plank 115' and a two "unit" plank 115. These can be substitute and/or complements for each other. One is a center post and symmetric and balanced in itself, and the other is an outer beam which you need two of to accomplish the same thing. In addition, rotatable and angled connections are possible with the pivotable hand connector clip of Figure SA (i.e., plank 115' (FIG. 17) or plank 115 (FIG. 16) may be rotated anywhere along the full 360° with clips 250 within holes 114 of clips 100.

For example, this proportional relationship is shown in FIG. 16 including vertically oriented planks, where one plank (plank 115*b*) is three "units" long (i.e., 4⅝+2⅜ inches), while the other plank (plank 115) is two "units" in length (4⅝ inches). A pivotable hand connector clip 250 is connected to the shorter plank 115 using its channel 102, while the protrusion 252 is mated into hole 114 of a connector clip 100. This structure is mirrored at the opposite end of the two "unit" length plank 115. The extra long plank 115*b* (3 "units") just spans the distance so as to occupy only half the length of the channel 102 (at top and bottom of the overall structure) of top and bottom connector clips 100.

The proportionality of the pivotable hand connector clip 250 may be such that its length 217 from floor 108 to the distal end of mating protrusion 252 is equal to one half of a "unit". Stated another way, the length from floor 108 to the center R of the D-shaped hole 214 (i.e., the center end of the radius R defining the interior surface of hole 214) may be one quarter of a "unit". Furthermore, the depth of connector clip 100 (i.e., the length of any given channel 102) may be two times the length of mating protrusion 252, so that when mating protrusion 252 (about 10 mm in length) is inserted into hole 114 of connector clip 100, it occupies half the length of tunnel or hole 114 (i.e., another pivotable hand connector clip 250 could be similarly inserted into the opposite side of tunnel or hole 114 of connector clip 100. The plank thickness may be such that when protrusion 252 is inserted in a hole 114 of a plank, it occupies substantially all the length of such a hole 114. Any of the other illustrated connector clips may include similar proportional features as described herein.

The clips 250*a* shown in FIG. 5B may provide different proportionality characteristics, as they are shorter in length, and distance 217' is less than distance 217 of Figure SA. FIG. 18 illustrates a stair-like structure, illustrating such proportionality. Here, two times the distance 219' from floor 108 to the base of protrusion 252 plus the length of a given plank (e.g., a two unit plank) is equal to the distance from the center of the star connector 100 to the center of the next star connector 100, with a given plank of identical length (e.g., two unit) fully seated within the channels 102 of each connector 100. Stated another way, the distance from floor 108 to a center of protrusion 252 (which protrusion is approximately equal in length to the thickness of plank 215*a*) on connector 250*a* may be equal to the distance from floor 108 to the center of hole 114 of connector 100 (which center of hole 114 is aligned with the center of plank 215*a* in the lateral downward channel 102, through which protrusion 252 is engaged (i.e., in hole 114 of plank 215*a*). Under either scenario, as a result, as seen in FIG. 18, a two "unit" plank 215*a*, the ends of which are engaged into channels 102 of respective clips 250*a* just spans the distance between parallel two unit length planks 215*a*, with protrusions 252 of clips 250*a* received into holes 114 of planks 215*a*. In other words, the length of the plank 215*a* and the two distances 219', provided by the two clips 250*a* spans the distance from center to center of connectors 100, with two unit plank 215 disposed therebetween. Such a proportional building structure is shown as forming a stair-like structure. Other uses for the proportionality are of course also possible.

V. Buttons and Panels

Figure 10:
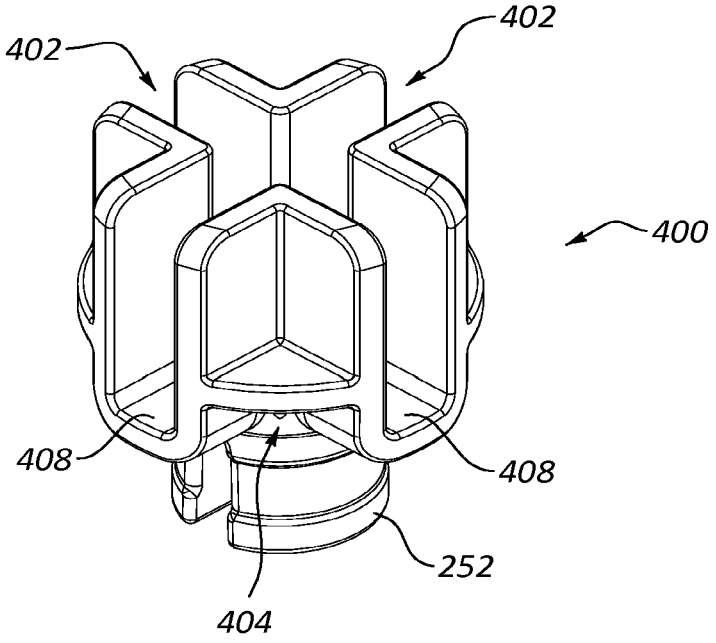
FIG. 10 illustrates a "button" clip for use in securing panels to a structure formed from blocks or planks and connector clips.

In an embodiment, the internal width of the channels (and the thickness of the planks or blocks) is about 8 mm (0.32 inch). FIG. 10 shows a connector clip (referred to informally by the inventor as a button) 400 including a protrusion 252 similarly sized and shaped as protrusion 252 of clip 250 of Figure SA, which can be lockingly inserted (i.e., retained) in hole 114, or any of receptacles 206, of any of the components (e.g., a hole 114 of any of the planks of FIG. 9A-9B, a hole 114 of a connector 100, etc.). Button clip 400 further includes one or more channels 402. Channels 402 may be configured to be smaller in width than channels 102 (e.g., of clip 100). For example, channels 102 of clip 100 (and other channels referenced as channels 102) may have a width of about 8 mm, while channels 402 of button clip 400 may be about 4 mm in width. In other embodiments, the width of channels 402 could be greater (e.g., even equal to or greater than the width of channels 102).

Figure 19:
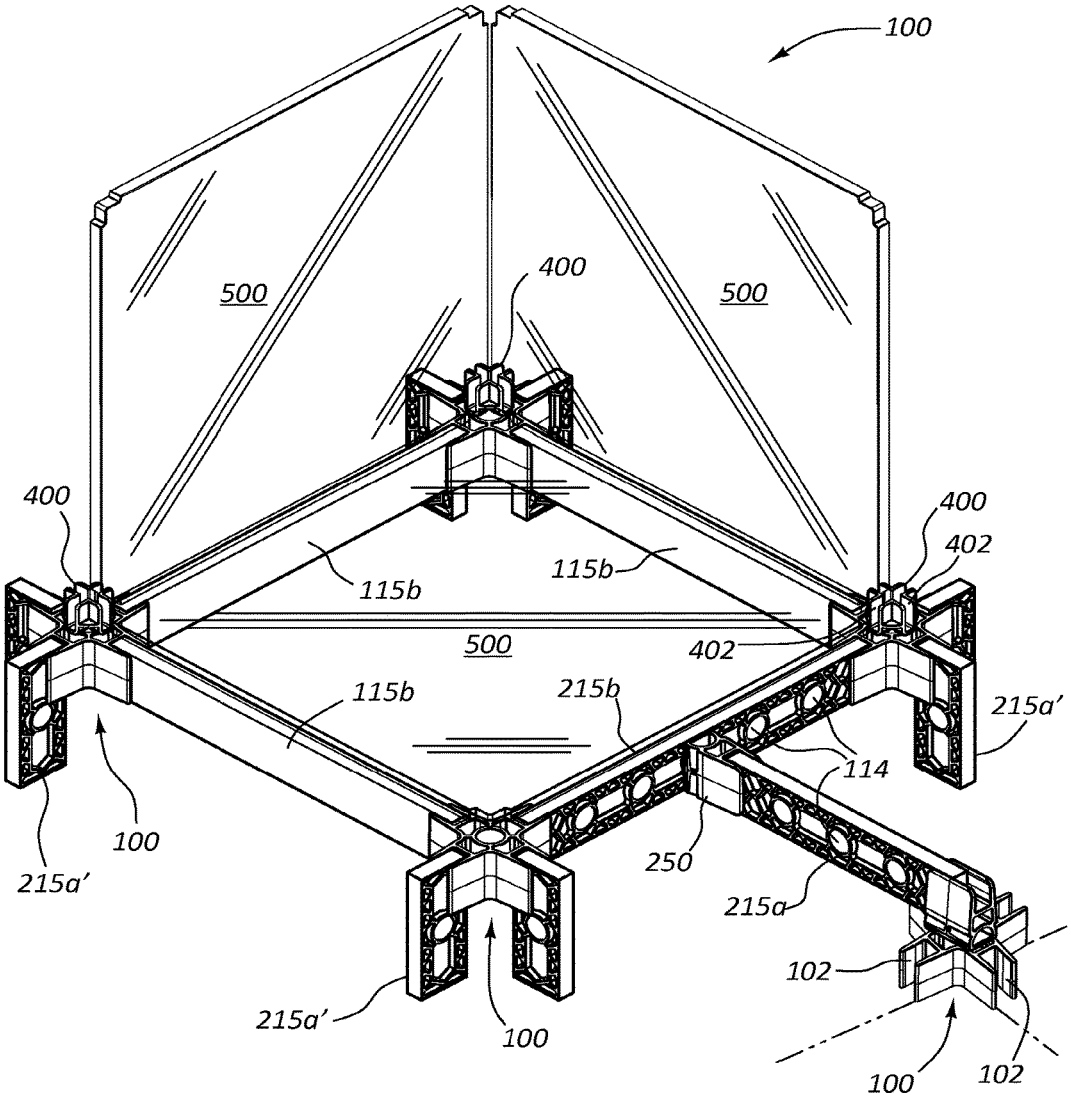
FIG. 19 illustrates components of an exemplary building set employed in the construction of a structure.

FIG. 11 shows a panel 500 for use with button clip 400, while FIG. 12 shows two panels 500 engaged with button clip 400 (e.g., one of panels 500 is in channel 402, the other is in recess 404). As shown, a panel 500 may be inserted into channel 402 to approximately the center of button clip 400, retaining the panel in place. Channels 402 are illustrated as extending vertically (e.g. in the same longitudinal but opposite direction (i.e., up) as protrusion 252, while a corner 502 of the other panel 500 (e.g., a horizontal panel) may be inserted into recess 404, vertically above the floor 408 of channel 502, also vertically above the distal end of protrusion 252. In this way, the vertical panels 500 may play the role of walls, while the horizontal panel may be a floor. It will be appreciated that the button may be flipped sideways, or upside down, so that the reference to vertical, horizontal, etc. is only relative to the orientation shown. FIG. 19 shows a structure including button connector clips 400, panels 500, and several of the other building set components described herein. As seen in FIG. 19, the button connector clips 400 may be connected into the hole 114 of a connector clip 100. FIG. 19 also illustrates the narrower width of channels 402 relative to channels 102.

FIG. 19 shows various building configurations that may be achieved by placement of the protrusion 252 of button clip 400 into the central hole 114 of a connector clip 100, and then placing panels 500 into one or more of channels 402. Channel 402 may provide the same open ended functionality as described above relative to channels 102 (e.g., see FIGS. 2A-2D), allowing the builder open ended freedom and creativity in how to engage one or more panels into channels 402.

While panels 500 are shown positioned generally flush with a corner in button connector clips 400, this is not required, so that various connectivity of the panel in the button clip 400 is possible, similar to as described relative to planks or blocks in channels 102.

The panels 500 may themselves also be proportional to the other building components. For example, in an embodiment, one or more of the panels may be square, or rectangular, with length and width dimensions that are whole number multiples of a "unit", plus the distance from the floor 108 of one channel connector 100 to the floor of the opposite channel connector 100. This allows the panel 500 to span the distance from one button 400 to the next button 400, each in hole 114 of connector 100, with a proportional unit plank between connectors 100. For example, in FIG. 19, panels 500 are shown as square with a length and width dimension equal to a three "unit" plank (e.g., about 7⅛ inches), plus the distance from the floor 108 of one channel of connector 100 to the floor of the opposite channel of the same connector. The photographs of the provisional application shows panels 500 as square with a length and width dimension equal to a two "unit" plank (e.g., about 4 and ⅝ inches). One of these photographs illustrating how the building systems may be employed is shown as FIG. 20. In any case, this allows for the structures shown, where the panel length or width spans from the center of one connector to the center of the other connector (with a plank disposed between the two connectors, as seen). Of course, panels could also be so provided based on a one "unit" length plank, or other "unit" length plank, plus the applicable connector clip distance, etc. In some building set embodiments, panels of varying sizes may be provided (e.g., based on one, two, and/or three "unit" planks).

As seen in FIG. 11, the corners 502 of each panel may be notched, facilitating insertion of protrusion 252 of a button clip 400 into a hole 114 of connector clip 100, with panel 500 serving as a floor, sandwiched or pinched between the upper portion of button clip 400 and connector clip 100. This arrangement is also shown in FIG. 19. For example, the corner 502 surrounding the notched out portion may be received within recess 404.

The button clips 400 may engage the panels 500 anywhere along the length or width of the panel (e.g., it does not have to be near the panel corner), similar to how channels 102 may engage a block or plank anywhere along the length, or width of a plank or block. Such flexibility in engagement is shown in the Figures, and will be apparent in light of the present disclosure. Furthermore, the buttons may be rotated within connector clip 100 hole 114 (or other hole or receptacle) to any desired orientation. The result of this is that the channel 402 of button clip 400 does not have to be perpendicular or parallel aligned with channels 102 of connector clips 100. For example, panels (e.g., wall panels) may be oriented at other than 90° relative to one another, so that rooms built with such panels and buttons do not have to have walls oriented at 90° to one another. Any angle is possible, as button 400 can be infinitely rotated within hole 114. In addition, while shown with channels 402 intersecting at 90° relative to each other, it will be apparent that other angled orientations of channels 402 are possible (e.g., 2 channels 180° apart, 3 channels at 120° apart, other numbers of channels equally spaced, or channels at unequally spaced intervals). While the floors of channels 402 are shown as flat, it will be appreciated that they could alternatively include an incline, if desired. Such a configuration would force the panel inserted therein to also be inclined.

The various connectors and planks may thus provide structural support to the building erected by the user, while the panels add a façade or finished appearance, with the button clips providing a mechanism for indirect attachment of the panels to the planks and connector clips. As the panels may provide a finishing touch to a toy structure, in an embodiment, the panels may be transparent or translucent. They may be formed of a plastic material exhibiting static cling properties, so that static cling window decals may be adhered (through static electric adhesion) to the panels, and removed or replaced, as desired. In another embodiment, the panels may be formed to include a whiteboard type erasable surface, so that they could be decorated using erasable whiteboard markers, and erased when desired, to be redecorated differently. Transparent panels may also be erasably decoratable using whiteboard markers, crayons, other markers, etc. In an embodiment, the panels may also be opaque (e.g., a filler may be included in the plastic resin used to form them). They may be formed from any of the plastic materials described herein (e.g., polyolefins such as polypropylene, polycarbonate, etc.)

An exemplary building set may include such markers, crayons (e.g., of any various colors, or multiple colors) for use in decorating the panels 500. Such writing instruments may include any colors, such as red, green, blue, orange, yellow, white, black, brown, purple, etc. Paints or other coloring or writing tools may similarly be provided. In an embodiment, stickers or decals (e.g., static clink decals) may be provided, pre colored or decorated, or with line drawings, which the user may place onto panels 500, and then color or decorate. Such line drawings or finished decorations could also be printed or otherwise provided directly and permanently on panels 500, although the removability of decals provides an added benefit in the ability to replace one with another, etc. In any case, it will be apparent that the building set allows a user to free form draw, color, or decorate, e.g., directly on the panels themselves, to color, draw, or decorate on decals or stickers that can be attached (e.g., removably) to the panels. Preferably the provided crayons, markers or other writing or coloring decorating tools are erasable, although permanent inks, colors, etc. may also be provided. Such building sets provide the ability for the user to employ mathematical, geometric, and related critical thinking skills in engineering and building a structure, while at the same time employing artistic skills in decorating the structure built, particularly the panels.

It will be appreciated that any of the disclosed components may be used with any other of the disclosed components, e.g., in various ways not specifically described herein, but will be apparent to one of skill in the art in light of the present disclosure.

It must be noted that, as used in this specification and the appended claims, the singular forms "a," "an" and "the" include plural referents unless the context clearly dictates otherwise.

Numbers, percentages, or other values stated herein are intended to include that value, and also other values that are about or approximately the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing process, and may include values that are within 10%, within 5%, within 1%, etc. of a stated value. Furthermore, the terms "substantially", "about" or "approximately" as used herein represents an amount close to the stated amount that still performs a desired function or achieves a desired result. For example, the term "substantially" "about" or "approximately" may refer to an amount that is within 10% of, within 5% of, or within 1% of, a stated amount or value.

All publications, patents and patent applications cited herein are hereby incorporated by reference in their entirety to the same extent as if each individual publication, patent or patent application was specifically and individually indicated to be incorporated by reference.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A building set, comprising:

one or more planks, at least one of which includes a first face, an opposing second face, a first side, an opposed second side, a first end, and an opposed second end, the at least one plank including a thickness defined between opposed faces, opposed sides, or opposed ends;

one or more connector clips, at least one of the connector clips including a clip body and a plank engaging channel, the channel of the clip including:

a base defining a floor;

first and second substantially parallel extensions, each including interior surfaces, the extensions extending distally from the base and defining a channel therebetween into which the thickness defined between opposed faces of the plank is receivable, a width of the channel being substantially equal to the thickness of the plank that is receivable within the channel so that the extensions pinch the thickness of the plank received within the channel, frictionally coupling the connector clip to a plank received within the channel; and a mating protrusion extending from the clip body, the mating protrusion being sized and shaped for receipt into a corresponding hole or recess of another connector clip, a plank, or a hub that removably receives and retains one or more connector clips.

2. The building set of claim 1, wherein the connector clip includes a single channel and a single mating protrusion, each extending from an opposite side of the clip body.

3. The building set of claim 1, wherein the mating protrusion is cylindrical, allowing continuous selective rotation of the mating protrusion within the corresponding hole or recess of another connector clip, a plank, or a hub.

4. The building set of claim 3, wherein the cylindrical mating protrusion is split.

5. The building set of claim 1, wherein the at least one plank includes a hole formed through the thickness thereof, the hole being configured to retainingly receive therein the mating protrusion of the connector clip.

6. The building set of claim 1, wherein the building set is proportional so that the at least one plank has a length that is a whole number of units in length, and the connector clip includes two channels disposed on different sides of the connector clip, a distance from the floor of one channel to a center of the connector clip, and from the center of the connector clip to the floor of the other channel being equal to one-half unit in length.

7. The building set of claim 1, wherein the building set is proportional so that the mating protrusion of the one or more connector clips is sized and shaped for receipt into a hole of the one or more planks and/or a similarly sized hole of another connector clip, wherein the at least one plank has a length that is a whole number of units in length, and the connector clip including the mating protrusion includes a distance from the floor of the channel to a center of the mating protrusion that is equal to a distance from a floor of a channel to a center of a second connector clip that includes two channels disposed on different sides thereof.

8. The building set of claim 7, wherein a length of the mating protrusion of the one or more connector clips including the mating protrusion is equal in length to the thickness of the plank.

9. The building set of claim 1, further comprising a button connector clip comprising a mating protrusion extending from a button connector clip body, the mating protrusion being sized and shaped for receipt into a hole of a plank and/or another connector clip, the button connector clip further comprising one or more channels formed into the button connector clip body opposite from the mating protrusion of the button connector clip.

10. The building set of claim 9, wherein the one or more channels of the button connector clip body are narrower than the channel of the first connector clip, so as to be capable of receiving and retaining a thickness of a panel that is thinner than the planks, rather than the one or more rectangular planks.

11. The building set of claim 10, further comprising one or more panels for retention within the channels of the button connector clip.

12. A building set, comprising:

one or more planks, at least one of which includes a first face, an opposing second face, a first side, an opposed second side, a first end, and an opposed second end, the at least one plank including a thickness defined between opposed faces, opposed sides, or opposed ends;

one or more first connector clips, at least one of the connector clips including a clip body and a plank engaging channel, the channel of the clip including:

a base defining a floor;

first and second substantially parallel extensions, each including interior surfaces, the extensions extending distally from the base and defining a channel therebetween into which the thickness defined between opposed faces of the plank is receivable, a width of the channel being substantially equal to the thickness of the plank that is receivable within the channel so that the extensions pinch the thickness of the plank received within the channel, frictionally coupling the connector clip to a plank received within the channel; and wherein the at least one plank includes a hole formed through the thickness between the faces; and wherein at least one of the first connector clips comprises a mating protrusion extending from the clip body, the mating protrusion being sized and shaped for receipt into the hole of the at least one plank.

13. The building set of claim 12, wherein the building set is proportional so that the at least one plank has a length that is a whole number of units in length, and the connector clip includes two channels disposed on different sides of the connector clip, a distance from the floor of one channel to the floor of the other channel, through a center of the connector clip, being equal to one-half unit in length.

14. The building set of claim 12, wherein the building set is proportional in a way that at least one of the first connector clips comprises a mating protrusion extending from the clip body opposite from the channel of the connector clip, the mating protrusion being sized and shaped for receipt into the hole of the at least one plank and/or a similarly sized hole of another connector clip, wherein the at least one plank has a length that is a whole number of units in length, and the connector clip including the mating protrusion includes a distance from the floor of the channel to a center of the mating protrusion being equal to a distance from a floor to a center of a second connector clip that includes two channels disposed on different sides thereof.

15. The building set of claim 14, wherein a length of the mating protrusion of the first connector clip is equal in length to the thickness of the plank.

16. The building set of claim 12, further comprising a button connector clip comprising a mating protrusion extending from a button connector clip body, the mating protrusion being sized and shaped for receipt into a hole of a plank and/or another connector clip, the button connector clip further comprising one or more channels formed into the button connector clip body opposite from the mating protrusion of the button connector clip.

17. The building set of claim 16, wherein the one or more channels of the button connector clip body are narrower than the channel of the first connector clip, so as to be capable of receiving and retaining a thickness of a panel that is thinner than the planks, rather than the one or more rectangular planks.

18. The building set of claim 17, further comprising one or more panels for retention within the channels of the button connector clip.

19. A building set, comprising:

one or more planks, at least one of which includes a first face, an opposing second face, a first side, an opposed second side, a first end, and an opposed second end, the at least one plank including a thickness defined between opposed faces, opposed sides, or opposed ends;

one or more first connector clips, at least one of the connector clips including a clip body and a plank engaging channel, the channel of the clip including:

a base defining a floor;

first and second substantially parallel extensions, each including interior surfaces, the extensions extending distally from the base and defining a channel therebetween into which the thickness defined between opposed faces of the plank is receivable, a width of the channel being substantially equal to the thickness of the plank that is receivable within the channel so that the extensions pinch the thickness of the plank received within the channel, frictionally coupling the connector clip to a plank received within the channel; and wherein the at least one plank includes a hole formed through the thickness between the faces; and further comprising a button connector clip comprising a mating protrusion extending from a button connector clip body, the mating protrusion being sized and shaped for receipt into a hole of a plank and/or another connector clip, the button connector clip further comprising one or more channels formed into the button connector clip body opposite from the mating protrusion of the button connector clip.

20. The building set of claim 19, wherein the one or more channels of the button connector clip body are narrower than the channel of the first connector clip, so as to be capable of receiving and retaining a thickness of a panel that is thinner than the planks, rather than the one or more rectangular planks.

21. The building set of claim 20, further comprising one or more panels for retention within the channels of the button connector clip.

* * * * *